US008281455B2

(12) United States Patent
Hwang et al.

(10) Patent No.: US 8,281,455 B2
(45) **Date of Patent: *Oct. 9, 2012**

(54) VACUUM CLEANER

(75) Inventors: Man Tae Hwang, Changwon-si (KR); Hae Seock Yang, Changwon-si (KR); Hoi Kil Jeong, Changwon-si (KR); Myung Sig Yoo, Changwon-si (KR); Jae Kyum Kim, Kimhae-si (KR); Moo Hyun Ko, Moonkyung-si (KR); Kie Tak Hyun, Changwon-si (KR); Jong Su Choo, Busan-si (KR); Young Bok Son, Changwon-si (KR); Kyeong Seon Jeong, Changwon-si (KR); Min Park, Busan-si (KR); Sung Hwa Lee, Changwon-si (KR); Il Joong Kim, Masan-si (KR); Jin Hyouk Shin, Busan-si (KR); Gun Ho Ha, Busan-si (KR); Jin Wook Seo, Busan-si (KR); Chang Ho Yun, Changwon-si (KR); Jin Young Kim, Busan-si (KR); Chang Hoon Lee, Changwon-si (KR); Yun Hee Park, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 519 days.

This patent is subject to a terminal disclaimer.

(21) Appl. No.: 12/407,975
(22) Filed: Mar. 20, 2009
(65) Prior Publication Data

US 2009/0249578 A1 Oct. 8, 2009

Related U.S. Application Data

(63) Continuation-in-part of application No. 11/565,241, filed on Nov. 30, 2006, now Pat. No. 7,749,295, which is a continuation-in-part of application No. 11/565,206, filed on Nov. 30, 2006, now Pat. No. 7,882,592, application No. 12/407,975, which is a continuation-in-part of application No. PCT/KR2007/005759, filed on Nov. 15, 2007.

(30) Foreign Application Priority Data

| | | |
|---|---|---|
| Dec. 10, 2005 | (KR) | 10-2005-0121279 |
| Dec. 20, 2005 | (KR) | 10-2005-0126270 |
| Dec. 29, 2005 | (KR) | 10-2005-0134094 |
| Feb. 24, 2006 | (KR) | 10-2006-0018119 |
| Feb. 24, 2006 | (KR) | 10-2006-0018120 |
| May 3, 2006 | (KR) | 10-2006-0040106 |
| May 17, 2006 | (KR) | 10-2006-0044359 |
| May 17, 2006 | (KR) | 10-2006-0044362 |
| May 20, 2006 | (KR) | 10-2006-0045415 |
| May 20, 2006 | (KR) | 10-2006-0045416 |
| May 23, 2006 | (KR) | 10-2006-0046077 |
| Sep. 6, 2006 | (KR) | 10-2006-0085919 |
| Sep. 6, 2006 | (KR) | 10-2006-0085921 |
| Oct. 10, 2006 | (KR) | 10-2006-0098191 |
| Jul. 16, 2007 | (KR) | 10-2007-0071127 |
| Jul. 16, 2007 | (KR) | 10-2007-0071128 |

(51) Int. Cl.
*A47L 9/10* (2006.01)

(52) U.S. Cl. ..... 15/347; 15/300.1; 15/352

(58) Field of Classification Search ..... 15/300.1, 15/347, 352

See application file for complete search history.

(56) References Cited

U.S. PATENT DOCUMENTS 83,469 A 10/1868 Crandall (Continued)

FOREIGN PATENT DOCUMENTS

AU 2005229774 8/2006

(Continued)

OTHER PUBLICATIONS

Canadian Office Action dated Jun. 30, 2010.

(Continued)

*Primary Examiner* — Lee D Wilson
*Assistant Examiner* — Shantese McDonald
(74) *Attorney, Agent, or Firm* — KED & Associaes LLP

(57) ABSTRACT

A vacuum cleaner is provided. The vacuum cleaner may include a main body, a dust collector, at least one pressing member, and a driver. The dust collector may be detachably attached to the main body and may include a dust storage chamber. The at least one pressing member may compress dust stored in the dust storage chamber. The driver may be disposed in the dust collector and actuate the at least one pressing member.

17 Claims, 20 Drawing Sheets

U.S. PATENT DOCUMENTS

| | | | | |
|---|---|---|---|---|
| 2,283,836 | A * | 5/1942 | White | 55/429 |
| 2,714,426 | A | 8/1955 | White | |
| 3,367,462 | A | 2/1968 | Bibbens | |
| 4,379,385 | A | 4/1983 | Reinhall | |
| 4,545,794 | A | 10/1985 | Himukai | |
| 4,601,082 | A | 7/1986 | Kurz | |
| 4,617,034 | A | 10/1986 | Ikezaki et al. | |
| 4,809,394 | A | 3/1989 | Suka et al. | |
| 5,033,151 | A | 7/1991 | Kraft et al. | |
| 5,135,552 | A | 8/1992 | Weistra | |
| 5,159,738 | A | 11/1992 | Sunagawa et al. | |
| 5,233,682 | A | 8/1993 | Abe et al. | |
| 5,251,358 | A | 10/1993 | Moro et al. | |
| 5,265,305 | A | 11/1993 | Kraft et al. | |
| 5,323,483 | A | 6/1994 | Baeg | |
| 5,542,146 | A | 8/1996 | Hoekstra et al. | |
| 6,192,550 | B1 | 2/2001 | Hamada et al. | |
| 6,460,217 | B2 | 10/2002 | Fukushima et al. | |
| 6,625,845 | B2 | 9/2003 | Matsumoto et al. | |
| 6,689,225 | B2 | 2/2004 | Illingworth | |
| 6,694,917 | B1 | 2/2004 | Wang | |
| 6,735,816 | B2 | 5/2004 | Oh et al. | |
| 6,757,933 | B2 | 7/2004 | Oh et al. | |
| 6,779,229 | B2 | 8/2004 | Lee et al. | |
| 6,782,584 | B2 | 8/2004 | Choi | |
| 6,922,868 | B1 | 8/2005 | Jeong | |
| 7,028,369 | B2 | 4/2006 | Park et al. | |
| 7,152,276 | B2 | 12/2006 | Jin et al. | |
| 7,351,269 | B2 | 4/2008 | Yau | |
| 7,475,449 | B2 | 1/2009 | Lee | |
| 7,481,868 | B2 | 1/2009 | Lee et al. | |
| 7,547,340 | B2 | 6/2009 | Park | |
| 7,582,128 | B2 | 9/2009 | Hwang et al. | |
| 7,601,188 | B2 | 10/2009 | Hwang et al. | |
| 7,608,123 | B2 | 10/2009 | Pineschi | |
| 7,640,625 | B2 | 1/2010 | Oh et al. | |
| 7,644,469 | B2 | 1/2010 | Beers et al. | |
| 7,647,672 | B2 | 1/2010 | Nam et al. | |
| 7,704,290 | B2 | 4/2010 | Oh | |
| 7,749,295 | B2 | 7/2010 | Hwang et al. | |
| 7,770,253 | B2 | 8/2010 | Ha et al. | |
| 7,785,381 | B2 | 8/2010 | Oh et al. | |
| 7,785,396 | B2 | 8/2010 | Hwang et al. | |
| 7,854,782 | B2 | 12/2010 | Oh et al. | |
| 7,958,598 | B2 | 6/2011 | Yun et al. | |
| 2001/0025395 | A1 | 10/2001 | Matsumoto et al. | |
| 2002/0073505 | A1 | 6/2002 | Bolden | |
| 2002/0088079 | A1 | 7/2002 | Oh | |
| 2002/0124538 | A1 | 9/2002 | Oh et al. | |
| 2004/0211025 | A1 | 10/2004 | Jung et al. | |
| 2004/0261216 | A1 | 12/2004 | Choi et al. | |
| 2005/0091787 | A1 | 5/2005 | Bair et al. | |
| 2005/0138763 | A1 | 6/2005 | Tanner et al. | |
| 2005/0172584 | A1 | 8/2005 | Oh et al. | |
| 2005/0252179 | A1 * | 11/2005 | Oh et al. | 55/337 |
| 2006/0123750 | A1 | 6/2006 | Lee et al. | |
| 2006/0230722 | A1 | 10/2006 | Oh et al. | |
| 2007/0136980 | A1 | 6/2007 | Fujiwara et al. | |
| 2007/0143953 | A1 | 6/2007 | Hwang et al. | |
| 2007/0209149 | A1 | 9/2007 | Lee | |
| 2007/0209339 | A1 | 9/2007 | Conrad | |
| 2008/0023035 | A1 | 1/2008 | Ha et al. | |
| 2008/0023036 | A1 | 1/2008 | Ha et al. | |
| 2008/0047094 | A1 | 2/2008 | Ha et al. | |
| 2008/0052870 | A1 | 3/2008 | Lee et al. | |
| 2008/0172824 | A1 | 7/2008 | Yun et al. | |
| 2008/0172993 | A1 | 7/2008 | Yun et al. | |
| 2008/0263816 | A1 | 10/2008 | Oh et al. | |
| 2008/0264007 | A1 | 10/2008 | Oh et al. | |
| 2008/0264014 | A1 | 10/2008 | Oh et al. | |
| 2008/0264015 | A1 | 10/2008 | Oh et al. | |
| 2008/0264016 | A1 | 10/2008 | Oh et al. | |
| 2009/0178231 | A1 | 7/2009 | Hwang et al. | |
| 2009/0178235 | A1 | 7/2009 | Yun et al. | |
| 2009/0178236 | A1 | 7/2009 | Yun et al. | |
| 2009/0229072 | A1 | 9/2009 | Hwang et al. | |
| 2009/0229073 | A1 | 9/2009 | Hwang et al. | |
| 2009/0235956 | A1 | 9/2009 | Hwang et al. | |
| 2009/0241286 | A1 | 10/2009 | Hwang et al. | |
| 2009/0249578 | A1 | 10/2009 | Hwang et al. | |
| 2009/0255083 | A1 | 10/2009 | Hwang et al. | |
| 2009/0266382 | A1 | 10/2009 | Hwang et al. | |
| 2009/0293221 | A1 | 12/2009 | Hwang et al. | |
| 2009/0293223 | A1 | 12/2009 | Hwang et al. | |
| 2009/0293224 | A1 | 12/2009 | Hyun et al. | |
| 2009/0293915 | A1 | 12/2009 | Hwang et al. | |

FOREIGN PATENT DOCUMENTS

| | | | |
|---|---|---|---|
| AU | 2007200406 | | 9/2007 |
| CN | 2162679 | | 4/1994 |
| CN | 2186039 | | 12/1994 |
| CN | 2409894 | | 12/2000 |
| CN | 1334061 | | 2/2002 |
| CN | 1593324 | | 3/2005 |
| CN | 1695537 | | 11/2005 |
| CN | 1695538 | | 11/2005 |
| CN | 1777385 | | 5/2006 |
| CN | 1778246 | | 5/2006 |
| DE | 102 40 618 | | 9/2003 |
| EP | 0 373 353 | | 6/1990 |
| EP | 0 375 327 | | 6/1990 |
| EP | 0 681 808 | | 11/1995 |
| EP | 1 371 318 | A2 | 12/2003 |
| EP | 1 671 569 | | 6/2006 |
| EP | 1 671 570 | | 6/2006 |
| EP | 01 136 028 | | 7/2006 |
| EP | 1 733 669 | | 12/2006 |
| EP | 1857032 | | 11/2007 |
| FR | 2 823 091 | | 10/2002 |
| GB | 2 368 516 | | 5/2002 |
| GB | 2 377 881 | | 1/2003 |
| GB | 2 388 769 | | 4/2004 |
| GB | 2404887 | | 2/2005 |
| GB | 2 406 064 | | 3/2005 |
| GB | 2416721 | | 2/2006 |
| GB | 2466625 | | 6/2010 |
| JP | 1972-14759 | | 8/1972 |
| JP | 50-022355 | | 3/1975 |
| JP | 53-051663 | | 5/1978 |
| JP | 54-28457 | | 3/1979 |
| JP | 54-51259 | | 4/1979 |
| JP | 54-085560 | * | 7/1979 |
| JP | 54-085561 | | 7/1979 |
| JP | 54-112357 | | 8/1979 |
| JP | 54-119272 | | 8/1979 |
| JP | 54-114358 | | 9/1979 |
| JP | 54-114366 | | 9/1979 |
| JP | 54-114367 | | 9/1979 |
| JP | 54161751 | | 12/1979 |
| JP | 55-74553 | | 6/1980 |
| JP | 56-26044 | | 3/1981 |
| JP | 58-84066 | A | 5/1983 |
| JP | 58-175532 | | 10/1983 |
| JP | 58-218934 | | 12/1983 |
| JP | 59-125354 | | 8/1984 |
| JP | 64-029246 | | 1/1989 |
| JP | 02-007927 | | 1/1990 |
| JP | 4-116933 | U | 10/1992 |
| JP | 06-054778 | | 3/1994 |
| JP | 7-241265 | | 9/1995 |
| JP | 07-313412 | | 12/1995 |
| JP | 408000514 | | 1/1996 |
| JP | 08-112223 | A | 5/1996 |
| JP | 08-140907 | | 6/1996 |
| JP | 10-243900 | | 9/1998 |
| JP | 11-004789 | | 1/1999 |
| JP | 2000-262449 | | 9/2000 |
| JP | 2002-143060 | | 5/2002 |
| JP | 2002-187336 | | 7/2002 |
| JP | 2002-360474 | | 12/2002 |
| JP | 2003-019097 | | 1/2003 |
| JP | 2003-119575 | | 4/2003 |
| JP | 2003-125995 | | 5/2003 |
| JP | 2003-190056 | A | 7/2003 |
| JP | 2003-199695 | | 7/2003 |
| JP | 2003-310502 | | 11/2003 |
| JP | 2003-310506 | A | 11/2003 |

| | | | | |
|---|---|---|---|---|
| JP | 2004-065357 | | | 3/2004 |
| JP | 2004-528087 | A | | 9/2004 |
| JP | 2004-528876 | | | 9/2004 |
| JP | 2005-34213 | | | 2/2005 |
| JP | 2005-324002 | | | 11/2005 |
| JP | 06-061439 | | | 3/2006 |
| JP | 2006-068500 | | | 3/2006 |
| JP | 3119575 | | | 3/2006 |
| JP | 2006-340972 | | | 12/2006 |
| JP | 02006340972 | A | * | 12/2006 |
| JP | 2007-007381 | A | | 1/2007 |
| JP | 2008-73066 | | | 4/2008 |
| JP | 2003-524522 | | | 8/2008 |
| KR | 1993-0008369 | | | 8/1993 |
| KR | 10-1995-0016643 | | | 7/1995 |
| KR | 10-1999-0050243 | | | 7/1999 |
| KR | 10-1999-0055544 | | | 7/1999 |
| KR | 20-2000-0011635 | | | 7/2000 |
| KR | 2002-0091510 | | | 12/2002 |
| KR | 10-2005-0005611 | | | 1/2005 |
| KR | 10-2005-013694 | | | 2/2005 |
| KR | 10-2005-0040122 | | | 5/2005 |
| KR | 10-0546629 | B1 | | 1/2006 |
| KR | 10-0553042 | B1 | | 2/2006 |
| KR | 10-2006-031442 | | | 4/2006 |
| KR | 2006-0116992 | | | 11/2006 |
| KR | 10-0730956 | | | 6/2007 |
| KR | 10-2007-084834 | | | 8/2007 |
| KR | 10-2007-088022 | | | 8/2007 |
| KR | 10-2007-0088023 | | | 8/2007 |
| KR | 10-2007-0112324 | | | 11/2007 |
| KR | 10-2007-0113353 | | | 11/2007 |
| KR | 10-0800188 | | | 1/2008 |
| KR | 10-0800189 | | | 1/2008 |
| KR | 10-0838886 | | | 6/2008 |
| KR | 10-0838887 | | | 6/2008 |
| RU | 2172132 | | | 8/2001 |
| RU | 2 243 714 | | | 1/2005 |
| RU | 2 269 919 | | | 9/2005 |
| SU | 1326236 | | | 7/1987 |
| WO | WO 00/74548 | | | 12/2000 |
| WO | WO/01/35809 | | | 5/2001 |
| WO | WO 01/60524 | | | 8/2001 |
| WO | WO 2004/064591 | | | 8/2004 |
| WO | WO2005099545 | | | 10/2005 |

OTHER PUBLICATIONS

U.S. Appl. No. 12/407,975, dated Jul. 23, 2010.
Japanese Office Action dated Aug. 3, 2010.
U.S. Office Action U.S. Appl. No. 12/406,779 dated Aug. 18, 2010.
U.S. Office Action U.S. Appl. No. 11/831,473 dated Sep. 1, 2010.
European Search Report dated Jan. 20, 2010.
Chinese Office Action dated Feb. 5, 2010. (with translation).
U.S. Appl. No. 11/965,133 Notice of Allowance dated Jan. 13, 2010.
U.S. Appl. No. 11/565,241 Notice of Allowance dated Feb. 19, 2010.
U.S. Appl. No. 11/831,564 Notice of Allowance dated Feb. 24, 2010.
Russian Office Action dated Sep. 28, 2007 issued in Application No. 2007103559 (translation only).
Australian Office Action dated Apr. 17, 2008 issued in Application No. 2007200408.
Russian Office Action dated Apr. 21, 2008 issued in Application No. 2007103560 (with translation).
Australian Office Action dated Jun. 3, 2008 issued in Application No. 2006249267.
Japanese Office Action dated Nov. 6, 2008 issued in Application No. 2006-333685.
Russian Office Action dated Mar. 25, 2009 issued in Application No. 2008102660 (with translation).
Australian Office Action dated Apr. 16, 2009 issued in Application No. 2008200340.
Chinese Office Action dated Aug. 21, 2009 issued in Application No. 200810008716.0 (with translation).
Japanese Office Action dated Nov. 25, 2009 issued in Application No. 2007-021083.
Japanese Office Action dated Nov. 25, 2009 issued in Application No. 2007-066748.
U.S. Office Action issued in U.S. Appl. No. 12/406,779 dated Feb. 3, 2011.
U.S. Office Action issued in U.S. Appl. No. 11/831,473 dated Feb. 4, 2011.
U.S. Office Action issued in U.S. Appl. No. 12/408,066 dated Feb. 10, 2011.
U.S. Office Action issued in U.S. Appl. No. 12/710,585 dated Feb. 10, 2011.
U.S. Office Action issued in U.S. Appl. No. 12/404,739 dated Feb. 18, 2011.
U.S. Office Action issued in U.S. Appl. No. 12/404,692 dated Mar. 9, 2011.
U.S. Office Action issued in U.S. Appl. No. 12/404,715 dated Mar. 9, 2011.
U.S. Notice of Allowance issued in U.S. Appl. No. 12/408,066 dated Mar. 21, 2011.
U.S. Notice of Allowance issued in U.S. Appl. No. 12/407,224 dated Mar. 28, 2011.
Japanese Office Action dated Jan. 4, 2011. (Application No. 2006-333685).
European Search Report dated Jan. 27, 2011. (Application No. 06125798.6-2316/1852048).
Russian Office Action dated Feb. 2, 2011 (Application No. 2009143355) (with translation).
Korean Office Action dated Mar. 18, 2010.
Korean Office Action dated Mar. 25, 2010.
U.S. Office Action U.S. Appl. No. 11/565,206 dated Apr. 19, 2010.
U.S. Notice of Allowance U.S. Appl. No. 11/831,519 dated Apr. 21, 2010.
Japanese Office Action dated May 13, 2010.
U.S. Office Action U.S. Appl. No. 11/831,473 dated May 14, 2010.
U.S. Office Action U.S. Appl. No. 12/406,803 dated May 26, 2010.
U.S. Office Action U.S. Appl. No. 11/965,133 dated Jul. 9, 2010.
Korean Office Action dated Aug. 29, 2008.
Japanese Office Action dated Sep. 18, 2008.
International Search Report and Written Opinion dated Dec. 10, 2008.
Japanese Office Action dated Dec. 24, 2008.
Chinese Office Action dated Feb. 6, 2009.
Japanese Office Action dated Mar. 12, 2009.
Japanese Office Action dated Mar. 13, 2009.
Chinese Office Action dated Apr. 3, 2009 (translation).
Chinese Office Action dated May 8, 2009 (translation).
Japanese Office Action dated May 22, 2009.
Chinese Office Action dated Jun. 5, 2009 (translation).
European Search Report dated Jun. 16, 2009 (in English).
Korean Office Action dated Jun. 19, 2009.
Chinese Office Action dated Jul. 3, 2009 (with translation).
Japanese Office Action dated Jul. 28, 2009 (with translation).
U.S. Office Action dated Feb. 11, 2008 U.S. Appl. No. 11/831,473.
U.S. Office Action dated Feb. 11, 2008 U.S. Appl. 11/831,564.
U.S. Office Action dated Jul. 24, 2008 U.S. Appl. No. 11/831,473.
U.S. Office Action dated Jul. 28, 2008 U.S. Appl. No. 11/712,958.
U.S. Office Action dated Aug. 28, 2008 U.S. Appl. No. 11/713,022.
U.S. Office Action dated Sep. 19, 2008 U.S. Appl. No. 11/831,564.
U.S. Office Action dated Oct. 20, 2008 U.S. Appl. No. 11/831,473.
U.S. Office Action dated Mar. 9, 2009 U.S. Appl. No. 11/713,022.
U.S. Office Action dated May 28, 2009 U.S. Appl. No. 11/831,473.
U.S. Office Action dated Sep. 3, 2009 U.S. Appl. No. 11/831,564.
U.S. Office Action dated Sep. 10, 2009 U.S. Appl. No. 11/565,241.
Korean Office Action dated Sep. 17, 2010 issued in Application No. 10-2008-0065806.
U.S. Office Action dated Nov. 3, 2010 issued in U.S. Appl. No. 12/710,585.
U.S. Final Office Action dated Nov. 8, 2010 issued in U.S. Appl. No. 12/406,803.
U.S. Office Action dated Nov. 12, 2010 issued in U.S. Appl. No. 12/704,933.
Japanese Office Action dated Apr. 7, 2011. (2010-005365).
U.S. Office Action issued in U.S. Appl. No. 12/407,983 dated Jun. 21, 2011.
U.S. Notice of Allowance issued in U.S. Appl. No. 12/407,293 dated Jun. 29, 2011.

U.S. Office Action issued in U.S. Appl. No. 12/407,243 dated Jul. 18, 2011.
U.S. Office Action issued in U.S. Appl. No. 12/404,692 dated Jul. 20, 2011.
U.S. Office Action issued in U.S. Appl. No. 12/404,715 dated Jul. 22, 2011.
Korean Notice of Allowance dated Aug. 28, 2008. (KR10-2006-0018119).
Korean Notice of Allowance dated Aug. 28, 2008. (KR10-2006-0046077).
Korean Office Action dated Aug. 29, 2008. (KR10-2006-0085919).
Korean Notice of Allowance dated Sep. 26, 2008. (KR10-2006-0085921).
Korean Notice of Allowance dated Feb. 16, 2009. (KR10-2006-0045415).
Korean Notice of Allowance dated Apr. 28, 2009. (KR10-2006-0045416).
European Search Report dated Mar. 19, 2012.
U.S. Office Action issued in U.S. Appl. No. 12/407,243 dated Apr. 6, 2012.
U.S. Notice of Allowance issued in U.S. Appl. No. 12/404,715 dated Apr. 26, 2012.
U.S. Office Action issued in U.S. Appl. No. 12/407,243 dated Nov. 16, 2011.
U.S. Office Action issued in U.S. Appl. No. 12/404,692 dated Dec. 7, 2011.
U.S. Office Action issued in U.S. Appl. No. 12/404,715 dated Dec. 8, 2011.
U.S. Notice of Allowance issued in U.S. Appl. No. 12/710,585 dated Dec. 30, 2011.
Russian Office Action dated Oct. 19, 2010 issued in Application No. 2009143355 (with English translation).
Chinese Office Action dated Oct. 27, 2010 issued in Application No. 200610168848.0 (with English translation).
Chinese Office Action dated Nov. 9, 2010 issued in Application No. 200610169333.2 (with English translation).
U.S. Notice of Allowance dated Jan. 12, 2011 issued in U.S. Appl. No. 11/965,133.
Russian Office Action dated Oct. 4, 2007 (2007103555) (translation).
Russian Office Action dated Oct. 12, 2007 (2007103557).
Korean Office Action dated Mar. 25, 2008 (016285635).
Australian Office Action dated Apr. 15, 2008 (2007200407).
Australian Office Action dated Apr. 24, 2008 (2007200409).
European Office Action dated May 8, 2008 (07101388.Feb. 2316).
Korean Office Action dated Sep. 30, 2008 (050567614).
Chinese Office Action dated Dec. 12, 2008 (200710002992.1) (translation).
U.S. Office Action dated May 13, 2009 (U.S. Appl. No. 11/965,133).
Chinese Office Action dated May 22, 2009 (200710002992.1) (translation).
Japanese Office Action dated Jul. 28, 2009 (2007-066748).
Chinese Office Action dated Aug. 21, 2009 (200710002991.7) (translation).
U.S. Office Action dated Sep. 10, 2009 (U.S. Appl. No. 11/565,241).
U.S. Office Action dated Oct. 6, 2009 (U.S. Appl. No. 12/406,803).
European Search Report dated Oct. 15, 2009. (0162556.0/2316).
Japanese Office Action dated Nov. 4, 2009. (2007-019770).
Chinese Office Action dated Nov. 13, 2009 (200710085701.X) (translation).
Canadian Office Action dated Nov. 18, 2009 (2) (50514-26) (50514-27).
Japanese Office Action dated Nov. 25, 2009 (2007-019861).
Chinese Office Action dated Dec. 11, 2009 (200710002992.1).
Notice of Allowance dated Jan. 13, 2010 (U.S. Appl. No. 11/965,133).
Notice of Allowance dated Feb. 19, 2010 (U.S. Appl. No. 11/565,241).
Notice of Allowance dated Feb. 24, 2010 (U.S. Appl. No. 11/831,564).

* cited by examiner

VACUUM CLEANER

This application is a Continuation in Part of 1) U.S. patent application Ser. No. 11/565,241, filed Nov. 30, 2006, which is a Continuation in Part of U.S. patent application Ser. No. 11/565,206, filed Nov. 30, 2006, which claims priority to Korean Patent Application Nos. 2005-0121279 filed in Korea on Dec. 20, 2005, 2005-0126270 filed in Korea on Dec. 20, 2005, 2005-0134094 filed in Korea on Dec. 29, 2005, 2006-0018119 filed in Korea on Feb. 24, 2006, 2006-0018120 filed in Korea on Feb. 24, 2006, 2006-0040106 filed in Korea on May 3, 2006, 2006-0045415 filed in Korea on May 20, 2006, 2006-0045416 filed in Korea on May 20, 2006, 2006-0046077 filed in Korea on May 23, 2006, 2006-0044359 filed in Korean on May 17, 2006, 2006-0044362 filed in Korea on May 17, 2006, 2006-0085919 filed in Korea on Sep. 6, 2006, 2006-0085921 filed in Korea on Sep. 6, 2006, and 2006-0098191 filed in Korea on Oct. 10, 2006 and 2) PCT application No. PCT/KR2007/005759, filed Nov. 15, 2007, which claims priority to Korean Patent Application No(s). 10-2007-0071127 and 10-2007-0071128 filed in Korea on Jul. 16, 2007.

BACKGROUND

1. Field

A vacuum cleaner is disclosed herein.

2. Background

Vacuum cleaners are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
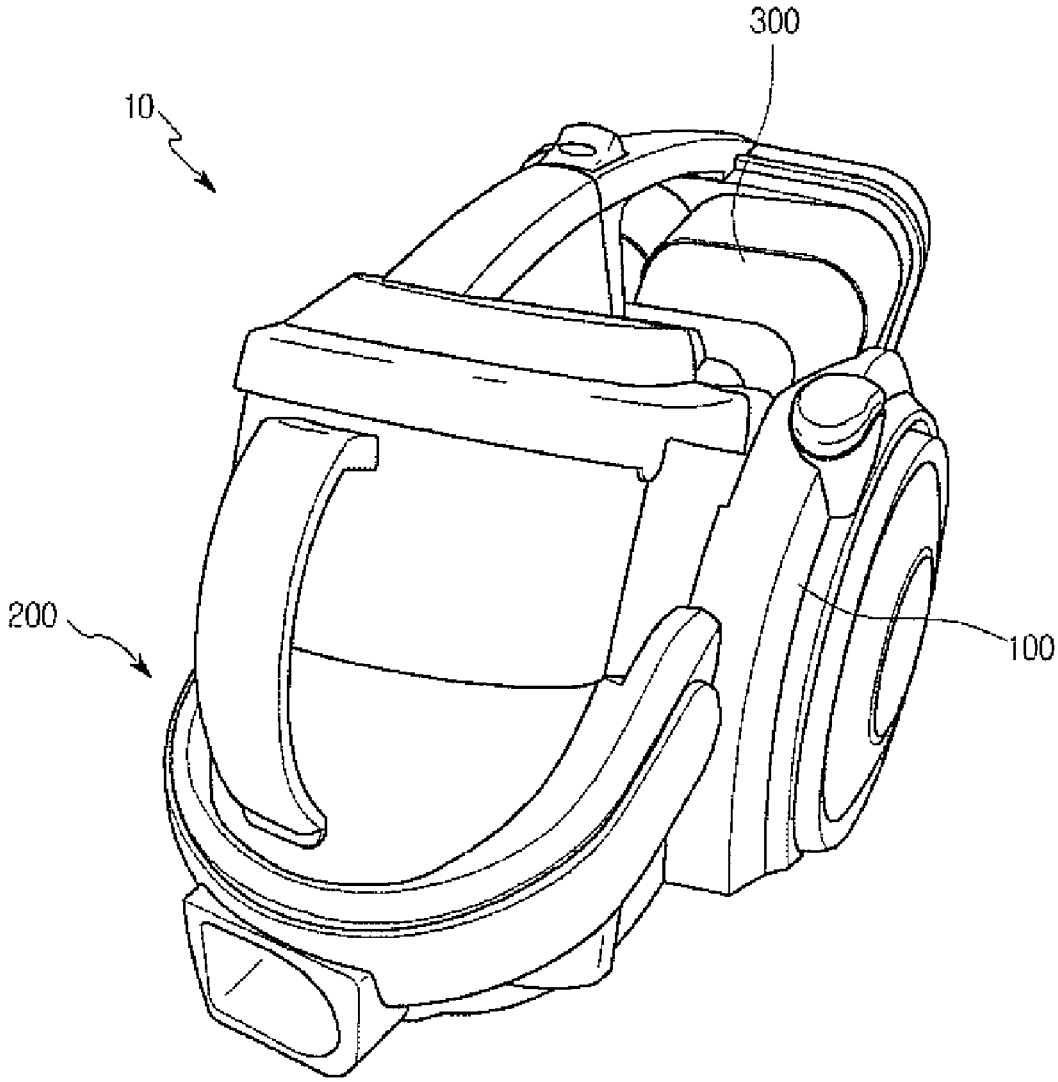
FIG. 1 is a front, perspective view of a vacuum cleaner according to an embodiment.

Reference will now be made in detail to embodiments, examples of which are illustrated in the accompanying drawings. Where possible, like reference numerals have been used to indicate like elements.

Generally, vacuum cleaners are used to suck in air and filter dust from the air using a suction motor installed in a main body. A vacuum cleaner may include a suction nozzle that sucks in air and dust, a main body connected to the suction nozzle, an extension conduit that guides air from the suction nozzle toward the main body, and a connection conduit connected between the extension conduit and the main body. A nozzle inlet having a predetermined size may be formed on a lower portion of the suction nozzle to easily suck air and dust from a floor.

A dust collector may be detachably attached to the main body to collect dust separated from air. The dust collector may separate dust from air sucked in through the suction nozzle and store the separated dust.

Figure 2:
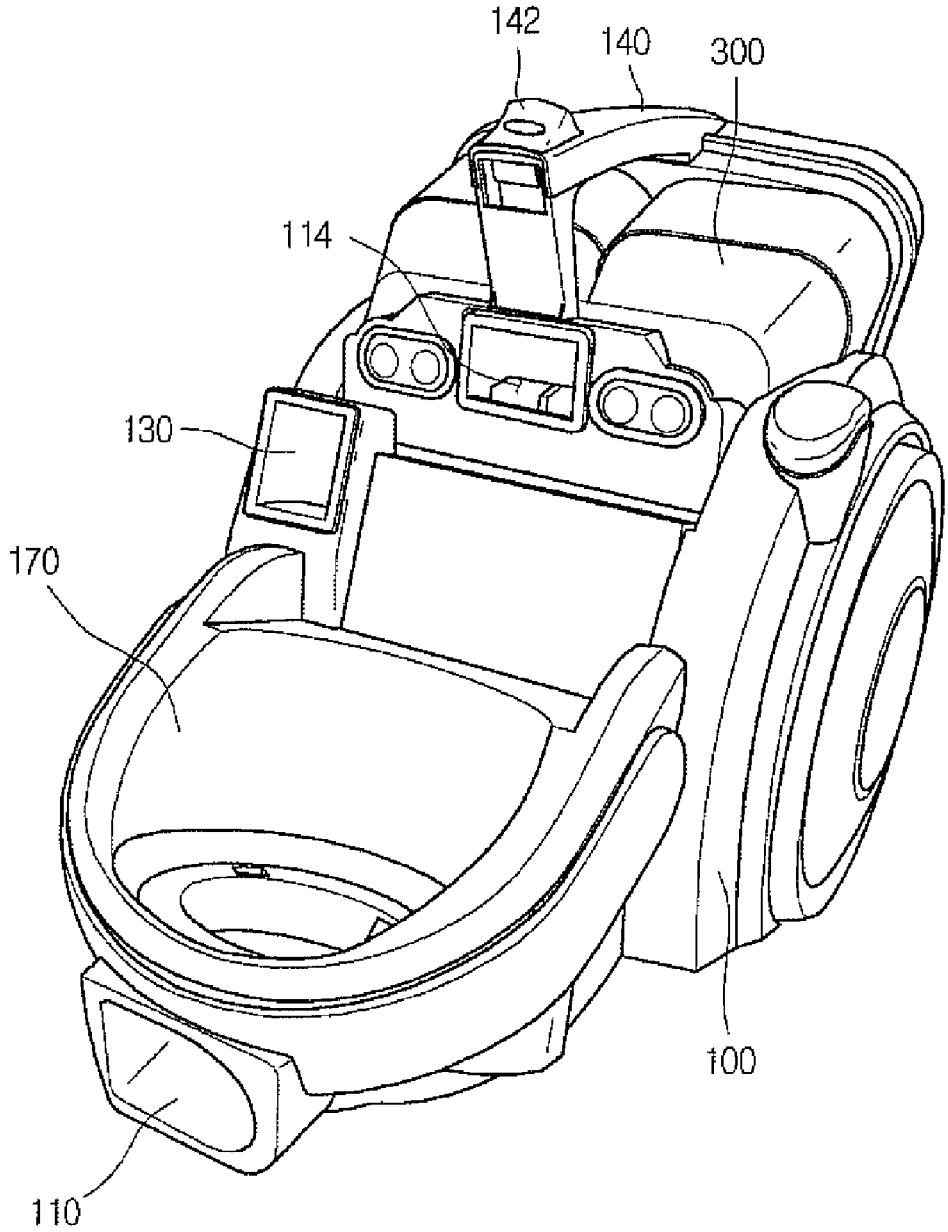
FIG. 2 is a front, perspective view of the vacuum cleaner when a dust collector is detached from the vacuum cleaner.
Figure 3:
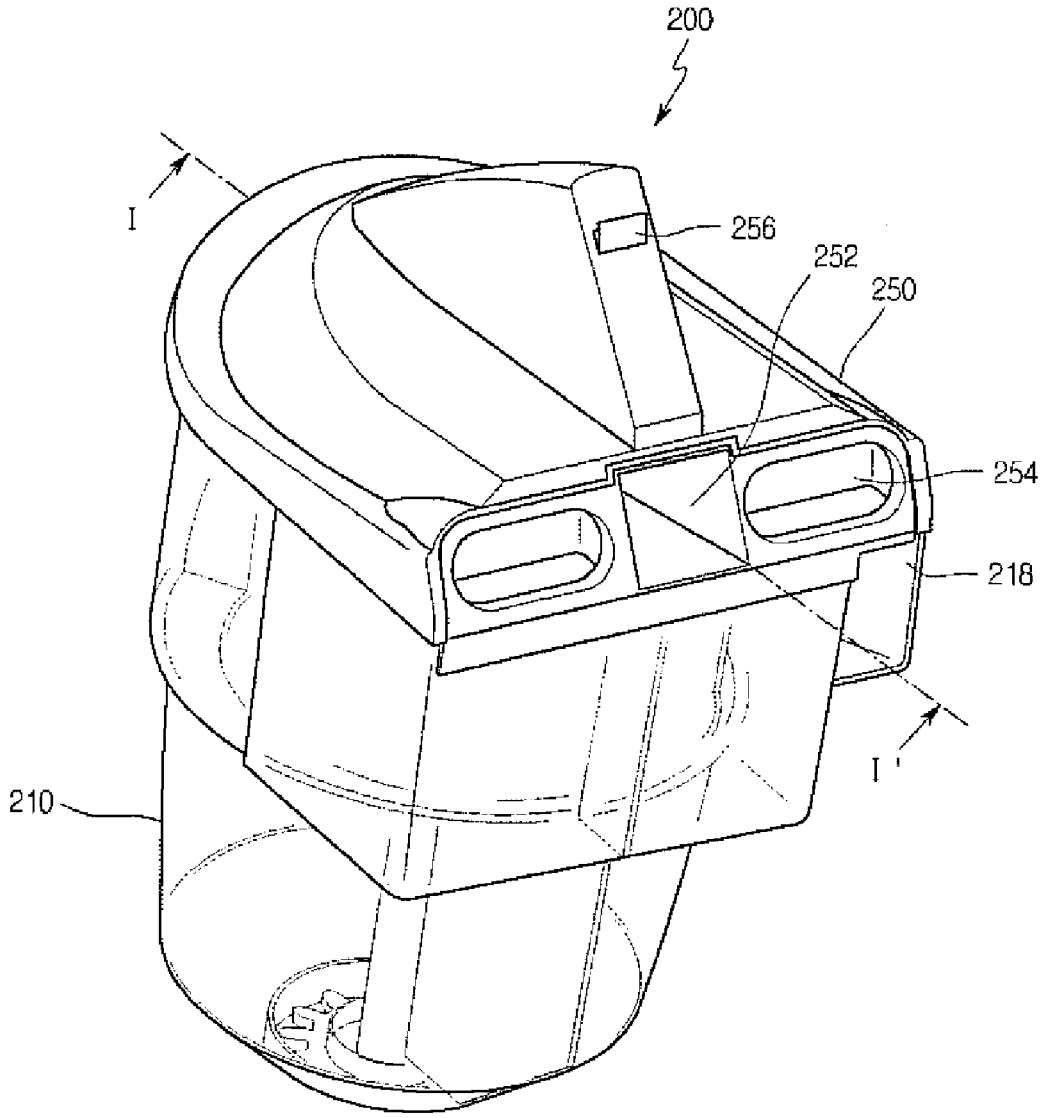
FIG. 3 is a rear, perspective view of the dust collector of FIG. 1.

FIG. 1 is a front perspective view of a vacuum cleaner 10 according to an embodiment. FIG. 2 is a front perspective view of the vacuum cleaner 10 when a dust collector 200 is detached from the vacuum cleaner 10. FIG. 3 is a rear perspective view of the dust collector 200 of the vacuum cleaner of FIG. 1.

Referring to FIGS. 1 to 3, the vacuum cleaner 10 of this embodiment may include a main body 100 and a dust separation device. A suction motor (not shown) may be disposed in the main body 100 that generates a suction force. The dust separation device may separate dust from air sucked into the main body 100.

The vacuum cleaner 10 may further include a suction nozzle (not shown) that sucks in air and dust and a connection device (not shown) that connects the suction nozzle to the main body 100. In this embodiment, detailed descriptions of the suction nozzle and the connection device have been omitted since the suction nozzle and the connection device have similar or the same structures as those of the related art.

The main body 100 may include a main body inlet 110, a main body outlet (not shown), and a main body grip 140. The main body inlet 110 may be formed in a front lower portion of the main body 100, and air and dust sucked in using the suction nozzle may be introduced into the main body 100 through the main body inlet 110. After dust is separated from air, the air may be discharged from the main body 100 through the main body outlet. The main body grip 140 may be formed on an upper portion of the main body 100, so that a user may easily carry the vacuum cleaner 10 using the main body grip 140.

The dust separation device may include a dust collector 200 and a second cyclone device 300. The dust collector 200 may include a first cyclone device 230 (see FIG. 4) that primarily separates dust from air, and the second cyclone device 300, which may be disposed in the main body 100 and secondly separate dust from the air.

The dust collector 200 may be detachably attached to a dust collector mount 170 formed at a front portion of the main body 100. To allow detachable mounting of the dust collector 200 on the main body 100, a hook lever 142 may be disposed on the main body grip 140, and a hook tap 256 corresponding to the hook lever 142 may be formed on the dust collector 200.

The first cyclone device 230 of the dust collector 200 may generate a cyclone that separates dust from air. The dust collector 200 may further include a dust collector body 210, in which a dust storage chamber may be formed. Dust separated from air by the first cyclone device 230 may be stored in the dust storage chamber of the dust collector body 210.

As explained above, the dust collector 200 may be detachably installed in or on the main body 100. When the dust collector 200 is installed in or on the main body 100, the dust collector 200 may communicate with the second cyclone device 300 of the main body 100.

An air outlet 130 may be formed in the main body 100, and a first air inlet 218 may be formed in the dust collector 200. Air sucked into the main body 100 may be discharged to the dust collector 200 through the air outlet 130 and the first air inlet 218.

In addition, a first air outlet 252 may be formed in the dust collector 200 that discharges air from the dust collector 200 after dust is primarily separated from the air by the first cyclone device 230 of the dust collector 200, and a connection passage 114 may be formed in the main body 100 that receives the air discharged from the dust collector 200 through the first air outlet 252.

Air introduced into the main body 100 through the connection passage 114 may be directed to the second cyclone device 300. The second cyclone device 300 may include a plurality of conical cyclones that may be connected to each other. Dust separated from air by the second cyclone device 300 may be stored in the dust collector 200. For this, a dust inlet 254 may be formed in the dust collector 200 to receive dust separated by the second cyclone device 300, and then, the dust may be stored in the dust storage chamber of the dust collector body 210.

Figure 4:
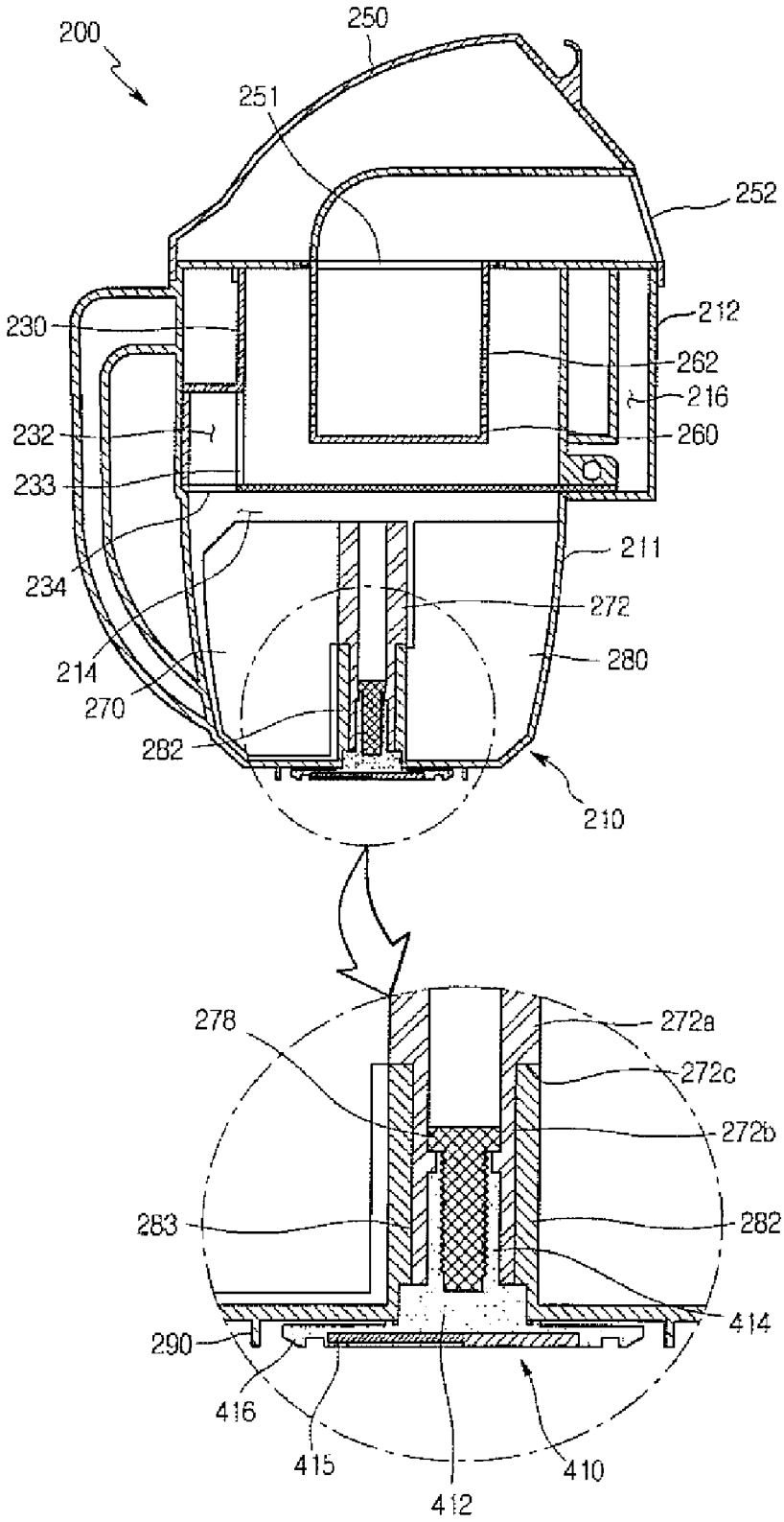
FIGS. 4A-4B are sectional views taken along line I-I' of FIG. 3.

The dust storage chamber of the dust collector body 210 may be divided into a first dust storage chamber 214 (see FIG. 4) and a second dust storage chamber 216 (see FIG. 4). Dust separated by the first cyclone device 230 of the dust collector 200 may be stored in the first dust storage chamber 214, and dust separated by the second cyclone device 300 may be stored in the second dust storage chamber 216. The dust collector 200 may have a structure that reduces a volume of dust stored in the dust storage chamber.

Figure 5:
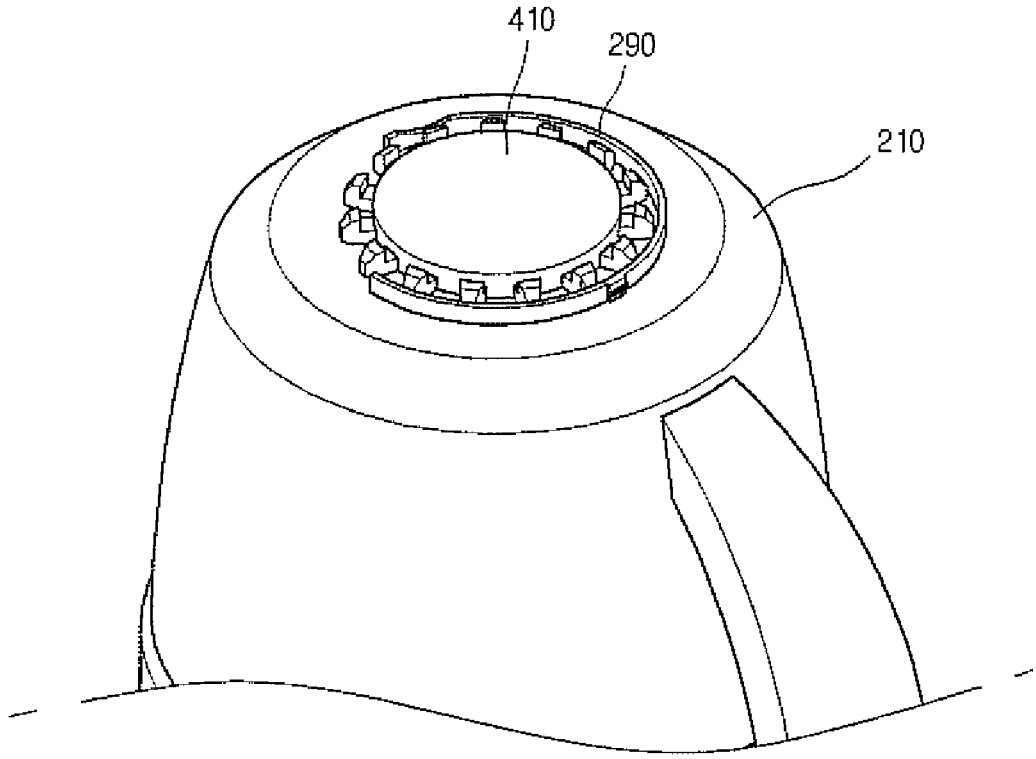
FIG. 5 is a front, perspective view of a dust collector mount of the vacuum cleaner of FIG. 1.

FIGS. 4A-4B are sectional views taken along line I-I' of FIG. 3. FIG. 5 is a front, perspective view of the dust collector mount 170 of the vacuum cleaner of FIG. 1. Referring to FIGS. 4A-4B and 5, the dust collector 200 may include the dust collector body 210 that forms an exterior of the dust collector 200, the first cyclone device 230 detachably attached to an inside of the dust collector body 210 that separates dust from sucked air, and a cover member 250 that selectively covers a top of the dust collector body 210.

The dust storage chamber may be formed in the dust collector body 210 and store dust separated from air. The dust storage chamber may include the first dust storage chamber 214 that stores dust separated by the first cyclone device 230 of the dust collector 200, and the second dust storage chamber 216 that stores dust separated by the second cyclone device 300.

The dust collector body 210 may include a first wall 211 that forms the first dust storage chamber 214 and a second wall 212 that forms the second dust storage chamber 216 in association with the first wall 211. The second wall 212 may be formed around a portion of the first wall 211, such that the second dust storage chamber 216 is formed around the first dust storage chamber 214.

The first cyclone device 230 may include a dust guide passage 232 that discharges dust separated from air to the first dust storage chamber 214. Dust may be introduced into the dust guide passage 232 in a tangential direction and may be discharged downward from the dust guide passage 232. For this, an inlet 233 of the dust guide passage 232 may be formed at a lateral portion of the first cyclone device 230, and an outlet 234 of the dust guide passage 232 may be formed at a lower portion of the first cyclone device 230.

The cover member 250 may be detachably attached to a top portion of the dust collector body 210. The first dust storage chamber 214 and the second dust storage chamber 216 both may be opened using the cover member 250. The first cyclone device 230 may be coupled to a lower portion of the cover member 250.

The cover member 250 may include a discharge hole 251 in the lower portion that discharges air from the first cyclone device 230 after dust is separated from the air. A filter member 260 may be attached to the lower portion of the cover member 250. The filter member 260 may include a plurality of penetration holes 262 in an outer surface thereof. Therefore, air may be discharged from the first cyclone device 230 through the filter member 260 and the discharge hole 251 after dust is separated from the air in the first cyclone device 230.

The cover member 250 may further include a passage 253 that guides air discharged from the first cyclone device 230 through the discharge hole 251 toward the first air outlet 252. That is, the passage 253 may be formed between the discharge hole 251 and the first air outlet 252.

A pair of pressing members 270 and 280 may be disposed in the dust collector body 210 that compresses dust stored in the first dust storage chamber 214. The pressing members 270 and 280 may interlock with each other to compress dust to reduce a volume of the dust. A density of the dust stored in the first dust storage chamber 214 may be increased due to the pressing members 270 and 280, and thus, a dust collecting capacity of the dust collector body 210 may be increased.

In the following description, the pressing member 270 may also be referred to as a "first pressing member," and the pressing member 280 may also be referred to as a "second pressing member." In this embodiment, at least one of the pressing members 270 and 280 may be rotatable in the dust collector body 210 to compress dust disposed between the pressing members 270 and 280. For example, when the pressing members 270 and 280 are rotatable in the dust collector body 210, the pressing members 270 and 280 may be rotated toward each other to reduce a distance between the pressing members 270 and 280 to compress dust disposed between the pressing members 270 and 280.

In this embodiment, the first pressing member 270 may be rotatable in the dust collector body 210, and the second pressing member 280 may be fixed to an inside of the dust collector body 210. That is, the first pressing member 270 may be a rotatable member, and the second pressing member 280 may be a fixed member.

The second pressing member 280 may be disposed between a rotational shaft 272 and an inner surface of the dust collector body 210. The rotational shaft 272 may be a rotational center of the first pressing member 270. That is, the second pressing member 280 may be disposed on a plane defined between an inner surface of the first dust storage chamber 214 and a centerline of the rotational shaft 272. The second pressing member 280 may partially or completely span a space between the inner surface of the first dust storage chamber 214 and the rotational shaft 272. The second pressing member 280 may be used together with the first pressing member 270 to compress dust by rotating the first pressing member 270.

One side of the second pressing member 280 may be formed integral with the inner surface of the dust collector body 210, and an other side of the second pressing member 280 may be formed integral with a fixed shaft 282 that may be coaxial with the rotational shaft 272. Alternatively, only one side of the second pressing member 280 may be formed integral with the inner surface of the dust collector body 210, or only the another side of the second pressing member 280 may be formed integral with the fixed shaft 282. That is, the second pressing member 280 may be fixed to at least one of the inner surface of the dust collector body 210 and the fixed shaft 282.

Although one side of the second pressing member 280 may not be integral with the inner surface of the dust collector body 210, the side of the second pressing member 280 may be close to the inner surface of the dust collector body 210. In addition, although the another side of the second pressing member 280 may not be integral with the fixed shaft 282, the another side of the second pressing member 280 may be close to the fixed shaft 282. In this case, dust pushed toward the second pressing member 280 by the first pressing member 270 may not readily escape through a gap formed at a lateral side of the second pressing member 280.

The pressing members 270 and 280 may comprise rectangular plates, and the rotational shaft 272 of the first pressing member 270 may be coaxial with a centerline of the dust collector body 210. The fixed shaft 282 may extend upward from a bottom surface of the dust collector body 210 and may include a hole 283 formed in an axial direction that couples with the rotational shaft 272. The rotational shaft 272 may be coupled to the fixed shaft 282 by inserting a portion of the rotational shaft 272 into the hole 283 from a top of the hole 283.

In this embodiment, the dust collector 200 may further include a driving device or driver 400 that rotates the first pressing member 270. The driving device 400 will now be described in more detail hereinbelow.

The driving device 400 may be detachably attached to a predetermined portion of the dust collector 200. For example, the driving device 400 may be detachably attached to a lower portion of the dust collector 200. When the driving device 400 is attached to the dust collector 200, the driving device 400 may be connected to the first pressing member 270. Since the driving device 400 may be attached to the dust collector 200, the driving device 400 may be removed from the main body 100 by detaching the dust collector 200 from the main body 100.

The driving device 400 may include a compression motor 410 that generates a driving force, a driving gear 430 that transmits the driving force from the compression motor 410 to the first pressing member 270, and a motor housing 420 that accommodates the compression motor 410. After placing the compression motor 410 in the motor housing 420, the motor housing 420 may be coupled to a coupling rib 290 formed on a lower portion of the dust collector body 210. For this, a coupling protrusion 422 may be formed on an outer surface of the motor housing 420, and a protrusion insertion hole 292 may be formed in the coupling rib 290 to receive the coupling protrusion 422.

The driving gear 430 may be coupled to a shaft 412 of the compression motor 410. When the driving device 400 is attached to the dust collector 200, the driving gear 430 may be connected to a lower portion of the rotational shaft 272. A gear coupling portion 273 corresponding to the driving gear 430 may be formed on the lower portion of the rotational shaft 272.

After the driving gear 430 is coupled to the rotational shaft 272, a coupling member 278 may be inserted into the rotational shaft 272 from the top of the rotational shaft 272 to join the driving gear 430 and the rotational shaft 272. The driving gear 430 may function as a power transmission member.

When the compression motor 410 rotates, the driving gear 430 connected to the compression motor 410 rotates. Therefore, the rotational shaft 272 may be rotated.

A terminal part 424 may be formed at a side of the motor housing 420 and may be connected to the compression motor 410. When the dust collector 200 is attached to the dust collector mount 170, the terminal part 424 may be connected to a power supply terminal 174 formed on the dust collector mount 170. Therefore, power may be supplied to the compression motor 410 from the main body 100. In this embodiment, power may be supplied to the compression motor 410 when the dust collector 200 is attached to the dust collector mount 170. In this case, the main body 100 may function as a power supply device for the compression motor 410.

The compression motor 410 may also rotate in a reverse direction. That is, the compression motor 410 may be a bidirectional motor capable of rotating bi-directionally.

In such a case, the first pressing member 270 may be rotated forwardly and backwardly. Therefore, compressed dust may be deposited on both sides of the second pressing member 280 by rotating the first pressing member 270 forwardly and backwardly.

For example, a bidirectional synchronous motor may be used as the compression motor 410. The synchronous motor may rotate bi-directionally without using an additional mechanism. When a force applied to the synchronous motor increases to a set value during rotation of the synchronous motor, the synchronous motor rotates in a reverse direction. For example, when the first pressing member 270 compresses dust, a reaction torque may be applied to the synchronous motor. If the reaction torque increases to a set value, the synchronous motor may rotate in a reverse direction.

Synchronous motor are well known to those of skill in the related art. Thus, a detailed description of the synchronous motor will be omitted.

Further, the compression motor 410 may continuously rotate the first pressing member 270 forward and backward at a predetermined angular velocity to facilitate compression of dust.

The dust collector mount 170 may be formed on the main body 100 to receive the dust collector 200. A mount recess 172 may be formed in the dust collector mount 170 to receive the driving device 400 when the dust collector 200 is mounted on the dust collector mount 170. The power supply terminal 174 may be formed in the mount recess 172 for selective connection to the terminal part 424 of the driving device 400.

Figure 6:
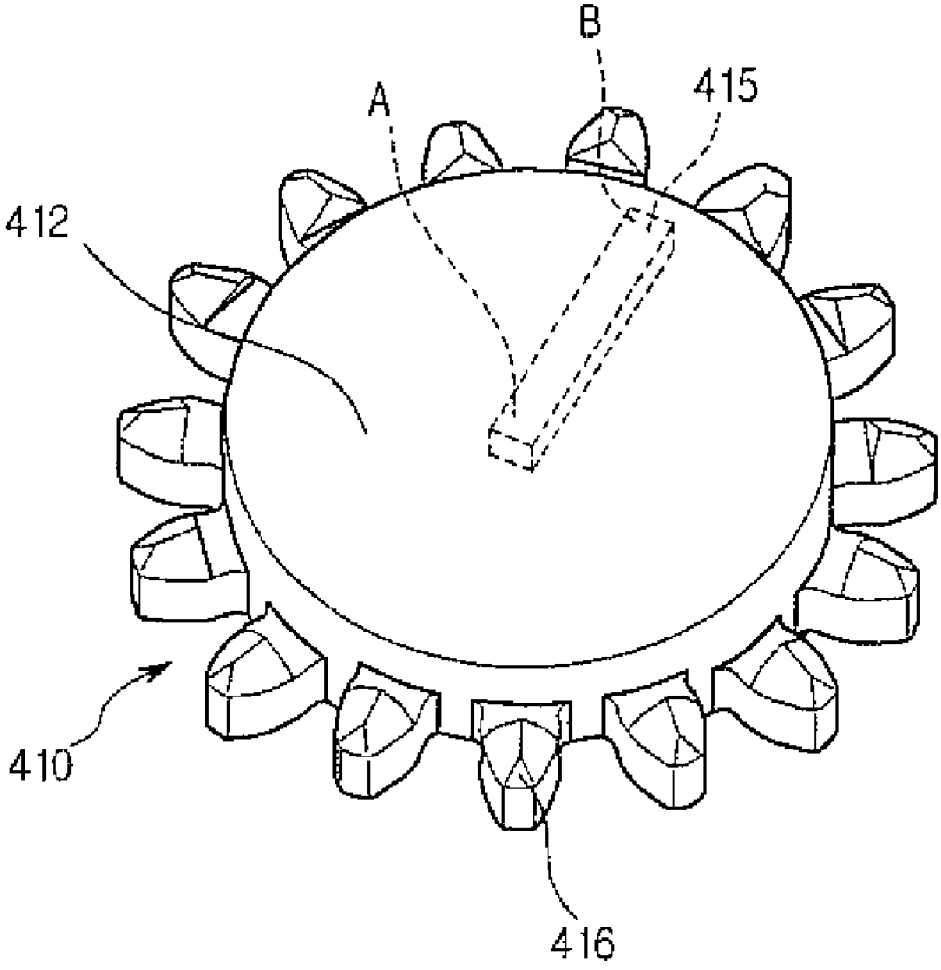
FIG. 6 is a vertical sectional view of the vacuum cleaner of FIG. 1.

FIG. 6 is a vertical sectional view of the vacuum cleaner 10 of FIG. 1. Referring to FIG. 6, the dust collector 200 may be coupled to the main body 100 of the vacuum cleaner 10 at a predetermined angle. In other words, a bottom of the dust collector 200 may make a predetermined angle with a plane that extends from a front side of the main body 100 to a rear side of the main body 100.

When the dust collector 200 is coupled to the main body 100, the second pressing member 280 formed in the dust collector body 210 may be close to the main body 100. That is, the second pressing member 280 may be disposed in a region of the first dust storage chamber 214 in which dust first starts to settle.

Therefore, dust discharged downward from the first cyclone device 230 may be accumulated on both sides of the second pressing member 280 since the dust collector 200 is inclined. In this case, much dust may be disposed between the first pressing member 270 and the second pressing member 280, and thus, dust compression efficiency may be increased.

An exemplary operation of the vacuum cleaner 10 will now be described in association with dust compression procedures with reference to FIGS. 1 to 6.

For cleaning desired areas or things, the dust collector 200 may first be mounted on the dust collector mount 170. Then, the terminal part 424 of the driving device 400 may be connected to the power supply terminal 174 of the dust collector mount 170. Thus, power may be supplied to the driving device 400 from the main body 100 of the vacuum cleaner 10.

Next, when powered on, the suction motor (not shown) operates to generate a suction force. Due to the suction force generated by the suction motor, air and dust may be sucked in through the suction nozzle (not shown). The air and dust may be guided to the main body 100 through the main body inlet 110 and pass through a predetermined passage. Then, the air and dust may enter the dust collector 200.

More specifically, in the dust collector 200, the air and dust may enter the first cyclone device 230 in a tangential direction through the first air inlet 218 of the dust collector body 210. In the first cyclone device 230, the air and dust may swirl down along an inner surface of the first cyclone device 230. While swirling down in the first cyclone device 230, the air and the dust may be separated by different centrifugal forces applied to the air and the dust due to different specific gravities. Then, the air may pass through the penetration holes 262 of the filter member 260 and may be discharged from the dust collector 200 through the discharge hole 251 and the first air outlet 252.

The dust may be separated from the air while swirling down in the first cyclone device 230 and enter the dust guide passage 232 in a tangential direction. In the dust guide passage 232, a moving direction of the dust may be changed. Thereafter, the dust may be discharged downward through the outlet 234 to the first dust storage chamber 214.

The air discharged from the first cyclone device 230 through the first air outlet 252 may be introduced back to the main body 100. Thereafter, the air may be discharged from the main body 100 to the second cyclone device 300 through the connection passage 114.

The air may be introduced into the second cyclone device 300 through a second air inlet (not shown) connected to an end of the connection passage 114 in a tangential direction of the inner surface of the second cyclone device 300. In the second cyclone device 300, dust may be secondly separated from the air.

Thereafter, the air may be directed from the second cyclone device 300 to the main body 100 where the air may pass by the suction motor and be discharged outside of the vacuum cleaner 10. The dust secondly separated from the air by the second cyclone device 300 may be directed to the dust collector 200 through the dust inlet 254 and may be accumulated in the second dust storage chamber 216. While the suction motor is driven to separate dust from air as described above, the driving device 400 may rotate the first pressing member 270 to compress dust settled in the first dust storage chamber 214.

Upon or after the operation of the suction motor, power may be supplied to the compression motor 410 from the main body 100 to drive the compression motor 410. Then, the driving gear 430 may transmit a driving force of the compression motor 410 to the first pressing member 270 to rotate the first pressing member 270 in a predetermined direction to compress dust.

While the first pressing member 270 compresses the dust, a reaction force may be applied to the first pressing member 270. If the reaction force reaches or exceeds a preset value, the rotation of the compression motor 410 may be reversed. In this case, the first pressing member 270 may rotate in a reverse direction to compress the other side dust. In this way, the first pressing member 270 may compress dust stored in the first dust storage chamber 214 while rotating in both directions. When the suction motor stops, the compression motor 410 may also stop.

In this embodiment, dust may be compressed using the pressing members 270 and 280, to increase the dust collecting capacity of the dust collector 200. Further, since dust may be compressed in the dust collector 200, a possibility of floating or scattering of the dust may be reduced, when the dust is removed from the dust collector 200. In addition, since the driving device 400 may be detachably attached to the dust collector 200, the dust collector 200 may be washed after detaching the driving device 400 to protect the driving device 400 from water permeation.

Figure 7:
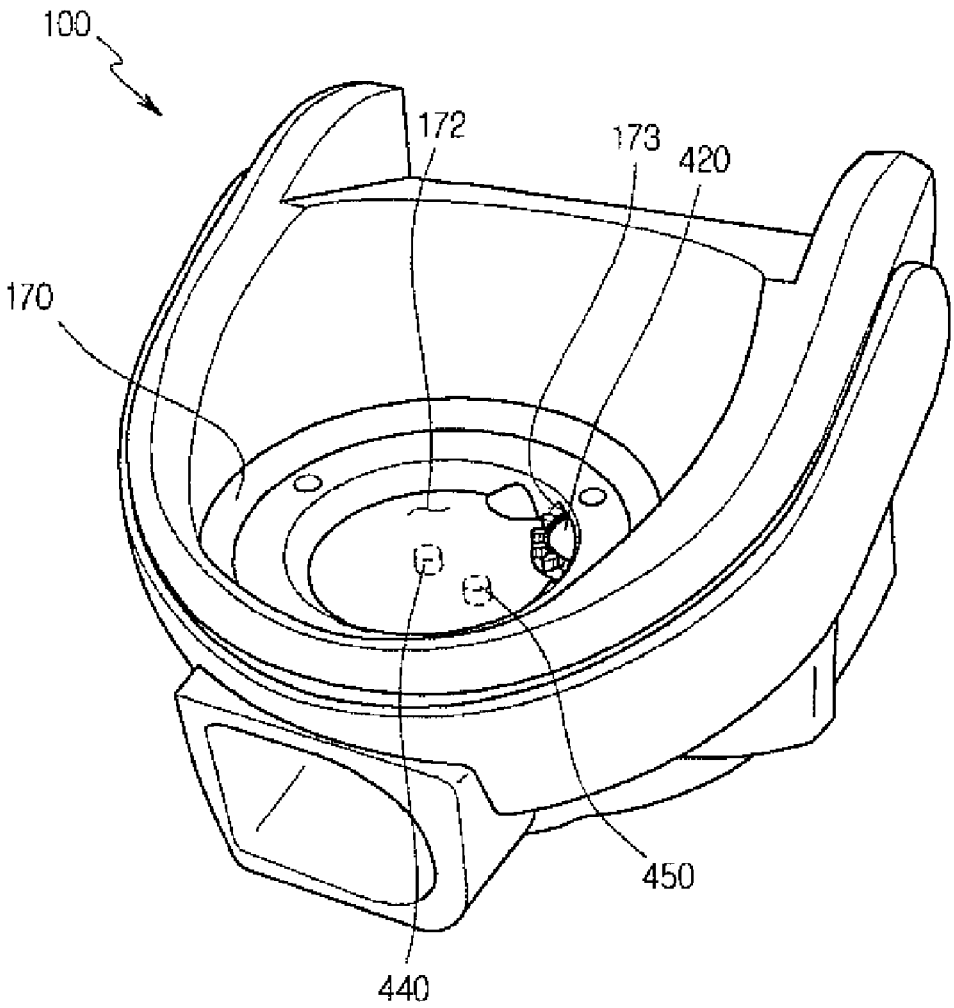
FIG. 7 is a vertical sectional view of a dust collector according to another embodiment.
Figure 8:
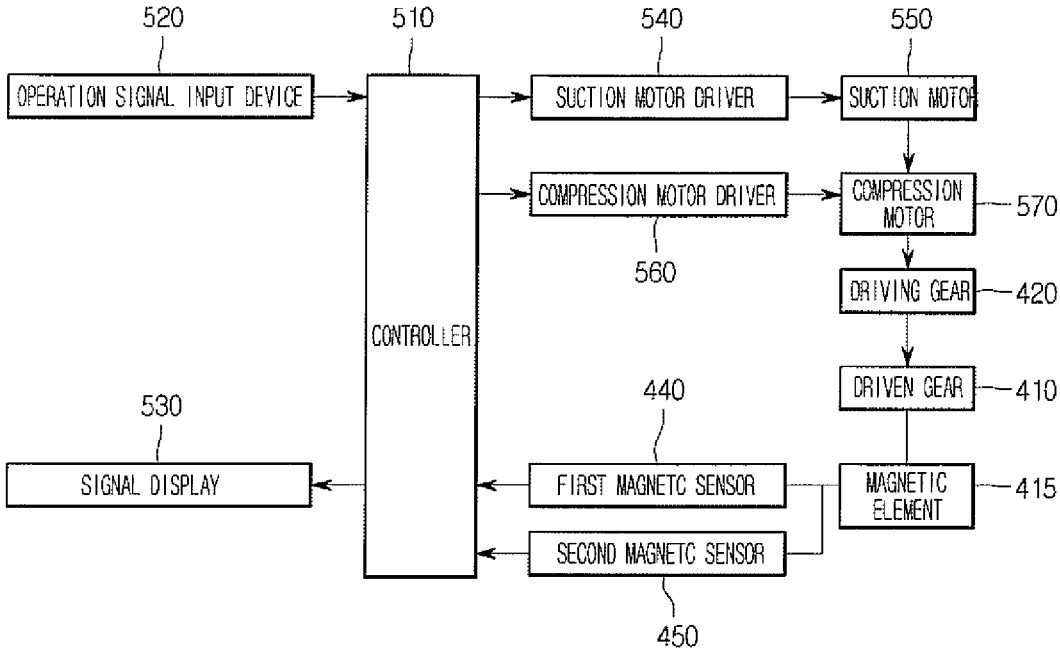
FIG. 8 is a sectional view taken along line II-II' of FIG. 7.

FIG. 7 is a vertical sectional view of a dust collector 500 according to another embodiment. FIG. 8 is a sectional view taken along line II-II' of FIG. 7.

Referring to FIGS. 7 and 8, in this embodiment, a driving device 600 may be attached to a sidewall of the dust collector 500. The dust collector 500 may include a cylindrical dust collector body 510, in which a dust storage chamber 511 may be formed, and a pressing member 550 coupled to a sidewall of the dust collector body 510.

The dust collector body 510 may include a mount rib 512, on which a rotational shaft 552 of the pressing member 550 may be placed. The mount rib 512 may extend inwardly from a sidewall of the dust collector body 510. The mount rib 512 may have a semi-circular shape, and the rotational shaft 552 may include a mount groove 555 that receives the mount rib 512.

A centerline of the rotational shaft 552 of the pressing member 550 may make a predetermined angle with a vertical line of the dust collector body 510. For example, the centerline of the rotational shaft 552 may extend substantially perpendicular to a vertical line of the dust collector body 510.

In other words, the rotational shaft 552 of the pressing member 550 may be substantially horizontally disposed in the dust collector body 510. In this case, the pressing member 550 may rotate vertically on the horizontal rotational shaft 552. The rotational shaft 552 placed on the mount rib 512 may be inserted through the sidewall of the dust collector body 510.

A motor shaft 612 of a compression motor 610 may be coupled to an end of the rotational shaft 552 inserted through the sidewall of the dust collector body 510. Alternatively, the motor shaft 612 of the compression motor 610 may be inserted through the sidewall of the dust collector body 510, and then, be coupled to the rotational shaft 552.

The pressing member 550 may include a semi-circular pressing plate 554. Since the dust collector body 510 has a cylindrical shape, dust stored in the dust collector body 510 may be effectively compressed using the semi-circular pressing plate 554.

The shape of the pressing plate 554 may be changed according to a horizontal section of the dust collector body 510. For example, when the dust collector body 510 has a rectangular shape, the pressing plate 554 may be formed in a rectangular shape.

A compartment rib 514 may protrude from a bottom surface of the dust collector body 510 to divide the dust storage chamber 511. The compartment rib 514 may be formed under the rotational shaft 552.

Further, the driving device 600 may include a motor housing 620 and the compression motor 610. The motor housing 620 may be coupled to a sidewall of the dust collector body 510, and the compression motor 610 may be disposed in the motor housing 620.

When the driving device 600 is coupled to the dust collector body 510, the motor shaft 612 of the compression motor 610 may be coupled to the rotational shaft 552. A terminal part 662 may be formed in the motor housing 620 to supply power to the compression motor 610. The structure that supplies power to the compression motor 610 through the terminal part 662 may be the same as that described with respect to the embodiment of FIGS. 1-6. Thus, repetitive description has been omitted.

It will now be described how dust is compressed in the dust collector 500.

When the compression motor 610 is powered on, the compression motor 610 may rotate in a predetermined direction. Then, the pressing member 550 connected to the compression motor 610 may be rotated in a predetermined direction (for example, clockwise in FIG. 8). In this case, a space between the pressing member 550 and a right bottom surface of the dust storage chamber 511 may be narrowed, such that dust stored at a right side of the compartment rib 514 may be compressed.

When a reaction force applied to the pressing member 550 reaches or exceeds a preset value, the compression motor 610 may rotate reversely. Then, the pressing member 550 may be rotated counterclockwise, as shown in FIG. 8. In this case, a space between the pressing member 550 and a left bottom surface of the dust storage chamber 511 may be narrowed, such that dust stored at a left side of the compartment rib 514 may be compressed. As explained above, the bottom surface of the dust storage chamber 511 may function as a fixed pressing member to compress dust in an interlocking relationship with the pressing member 550. That is, although a fixed pressing member such as the second pressing member 280 of the embodiment of FIGS. 1-6 is not used in this embodiment, dust may be effectively compressed since the bottom surface of the dust storage chamber 511 may function as a fixed pressing member. Since the dust storage chamber 511 may be divided by the compartment rib 514, dust stored in the dust storage chamber 511 may not be mixed while the dust is compressed by the pressing member 550.

Figure 9:
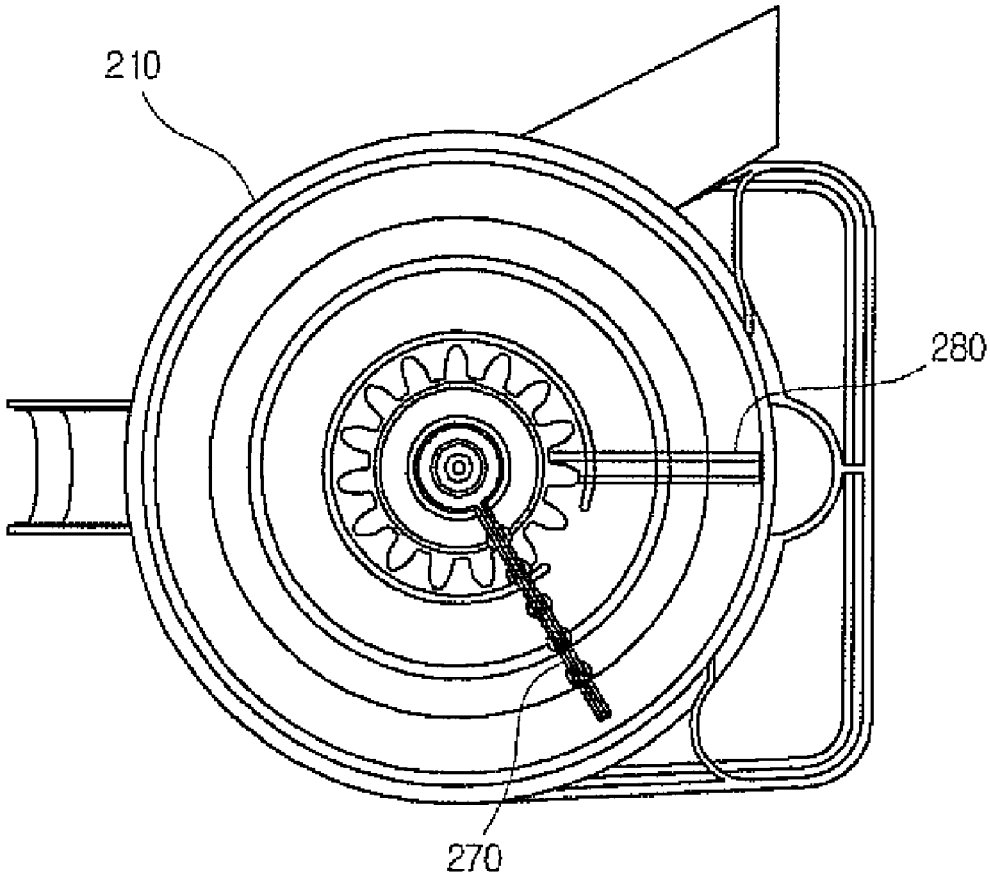
FIG. 9 is a vertical sectional view of a dust collector according to another embodiment.

FIG. 9 is a vertical sectional view of a dust collector 700 according to another embodiment. Referring to FIG. 9, the dust collector 700 of this embodiment may include a dust collector body 710, a compartment portion 711, and a cover member 730. The dust collector body 710 may form an exterior of the dust collector 700. The compartment wall 711 may divide an inside area of the dust collector body 710 into a dust separation chamber 712 and a dust storage chamber 714. The cover member 730 may be coupled to a top portion of the dust collector body 710.

A pressing member 750 may be disposed in the dust storage chamber 714 to compress dust stored in the dust storage chamber 714. The pressing member 750 may be connected to a driving device 800 attached to a sidewall of the dust collector body 710.

A suction hole 715 may be formed in a lower side of the compartment wall 711 to allow air to flow into the dust separation chamber 712. That is, air may be introduced into the dust separation chamber 712 from a lower side. An air discharge hole 717 may be formed in a bottom center portion of the dust separation chamber 712 to discharge air after dust is separated from the air. A discharge pipe 716 having a predetermined height may be disposed adjacent the air discharge hole 717.

The discharge pipe 716 may be vertically disposed in the dust separation chamber 712, such that air may be discharged from the dust separation chamber 712 in a direction substantially parallel to a vertical centerline of the dust collector body 710. A discharge passage 718 may be formed under the dust separation chamber 712. Air discharged from the dust separation chamber 712 may flow through the discharge passage 718.

A spiral flow guide 719 may be disposed in the dust separation chamber 712 around the discharge pipe 716. Due to the flow guide 719, air introduced into the dust separation chamber 712 through the lower suction hole 715 may swirl upward to the cover member 730.

A transportation passage 713 may be formed between the compartment wall 711 and the cover member 730 to allow dust separated in the dust separation chamber 712 to flow to the dust storage chamber 714. Further, a mount rib 720 may be formed on an inner surface of the dust storage chamber 714. A rotational shaft 752 of the pressing member 750 may be placed on the mount rib 720. The mount rib 720 may have a semi-circular shape. A mount groove 755 may be formed in the rotational shaft 752 to receive the mount rib 720.

A centerline of a rotational shaft 752 of the pressing member 750 may make a predetermined angle with a vertical line of the dust storage chamber 714. For example, the centerline of the rotational shaft 752 may extend substantially perpendicular to the vertical line of the dust storage chamber 714.

In other words, the rotational shaft 752 of the pressing member 750 may be horizontally disposed in the dust storage chamber 714. The rotational shaft 752 placed on the mount rib 720 may be inserted through a sidewall of the dust collector body 710. A drive device or driver 800 may be provided that includes a compression motor 820 disposed in a motor housing 810. The motor housing 810 may be coupled to the sidewall of the dust collector body 710. A motor shaft 822 of the compression motor 820 may be coupled to an end of the rotational shaft 752 inserted through the sidewall of the dust collector body 710.

The pressing member 750 may include a rectangular pressing plate 754. A compartment rib 721 may protrude from a bottom surface of the dust collector body 710 to divide the dust storage chamber 714. The compartment rib 721 may extend parallel to the rotational shaft 752.

When the driving device 800 is coupled to the dust collector body 710, the motor shaft 822 of the compression motor 820 may be coupled to the rotational shaft 752. A terminal part 812 may be formed in the motor housing 810, that supplies power to the compression motor 820. The structure for supplying power to the compression motor 820 through the terminal part 812 may be the same as that described with respect to the embodiments and of FIGS. 1-6. Thus, a detailed description has been omitted.

Further, since dust is compressed in the dust collector 700 in the same manner as in the embodiment of FIGS. 7-8, a detailed description thereof has been omitted. In this embodiment, a bottom surface of the dust storage chamber 714 may function as a fixed pressing member that compresses dust in an interlocking relationship with the pressing member 750. That is, although a fixed pressing member, such as the second pressing member 280 of the embodiment of FIGS. 1-6, may not be used in this embodiment, dust may be effectively compressed since the bottom surface of the dust storage chamber 714 may function as a fixed pressing member.

Figure 10:
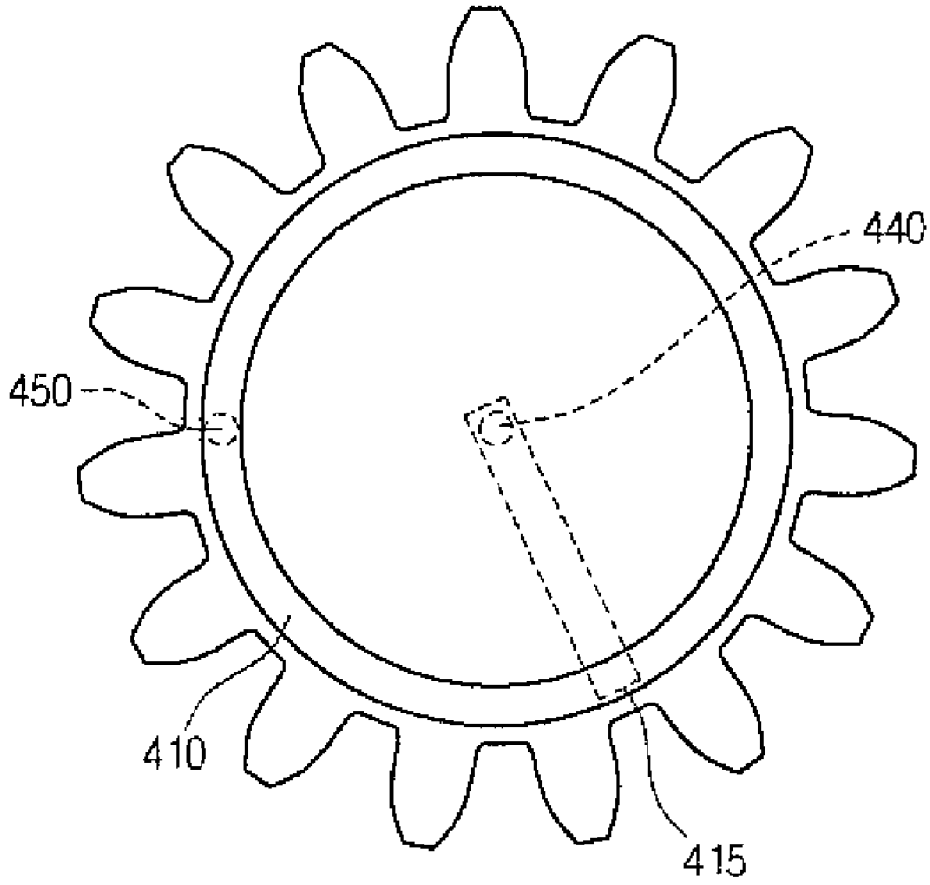
FIG. 10 is a perspective view of a vacuum cleaner when a dust collector is detached from the vacuum cleaner according to another embodiment.
Figure 11:
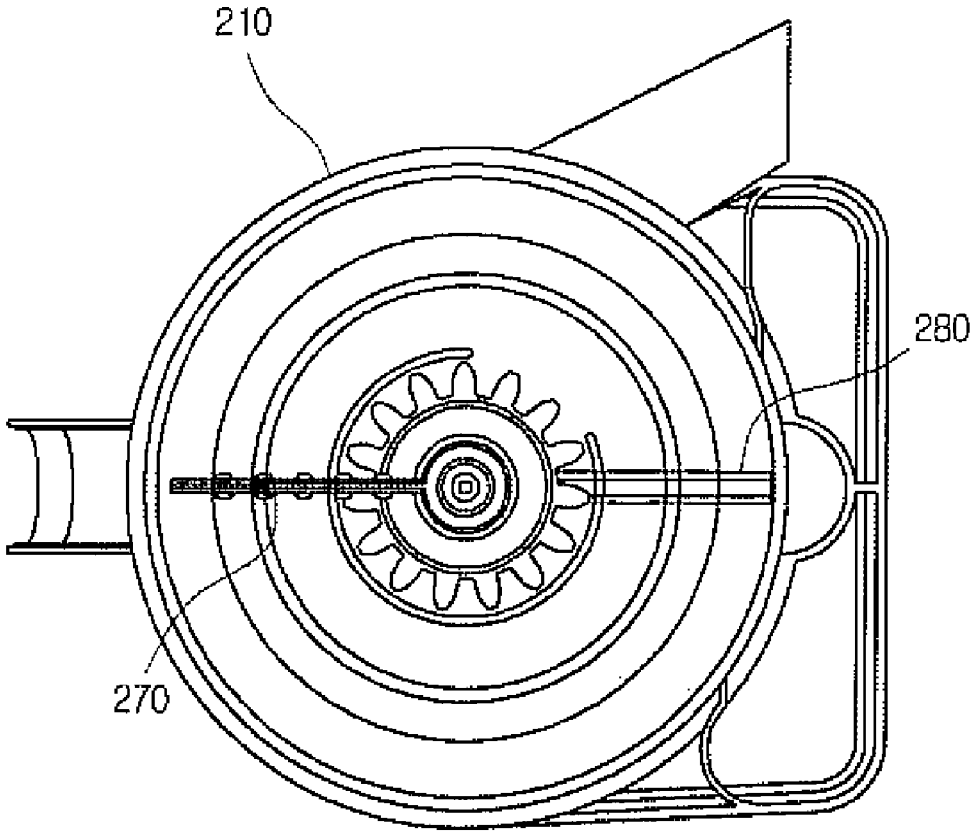
FIG. 11 is an exploded, perspective view of the dust collector of the vacuum cleaner of FIG. 10.
Figure 12:
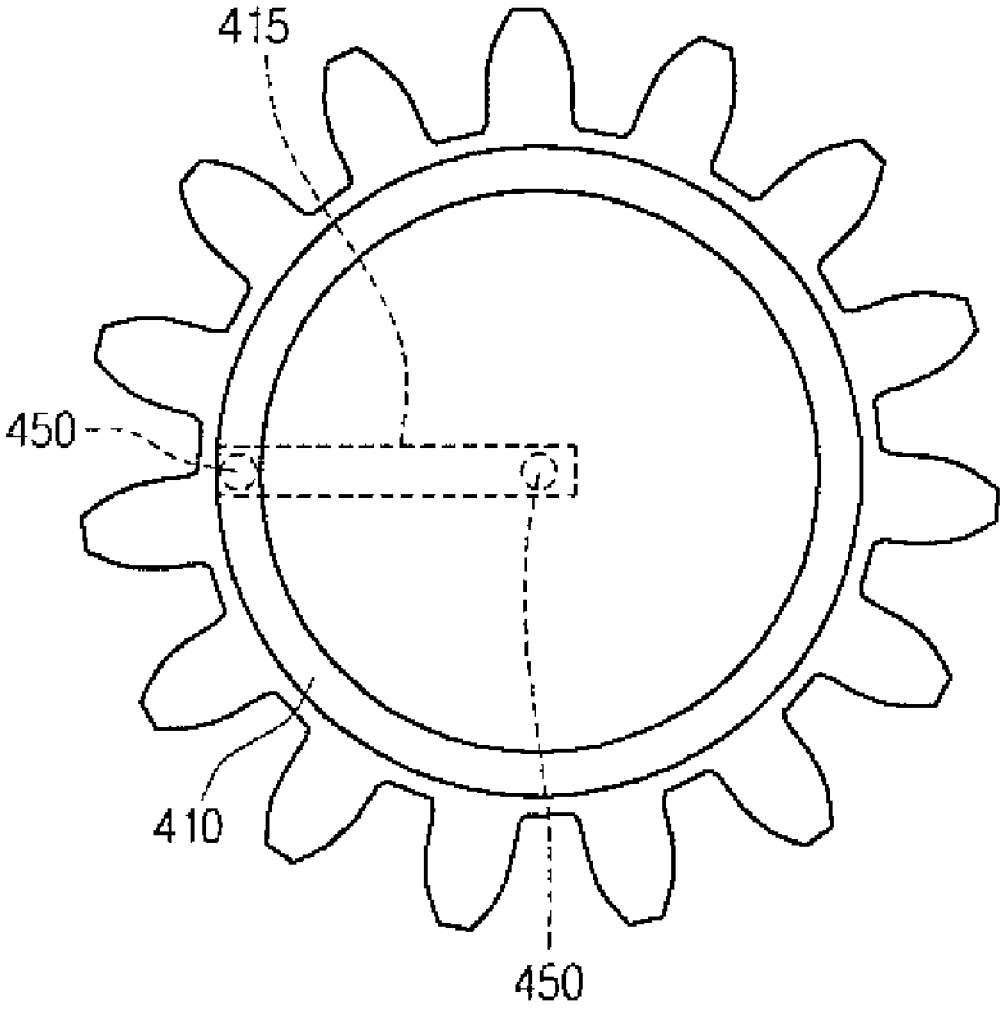
FIG. 12 is a sectional view taken along line III-III' of FIG. 10.

FIG. 10 is a perspective view of a vacuum cleaner 900 when a dust collector 1000 is detached from the vacuum cleaner 900 according to another embodiment. FIG. 11 is an exploded perspective view of the dust collector 1000 of FIG. 10. FIG. 12 is a sectional view taken along line III-III' of FIG. 10.

Referring to FIGS. 10 to 12, the vacuum cleaner 900 of this embodiment may include a main body 910 and the dust collector 1000. A suction motor (not shown) may be disposed in the main body 910. The dust collector 1000 may separate dust from sucked in air and store the separated dust.

A main body inlet 920 may be formed in a front lower portion of the main body 910. Air and dust sucked in through a suction nozzle (not shown) may be introduced into the main body 910 through the main body inlet 920. A main body outlet 930 may be formed at a side of the main body 910, that discharges air from the main body 910 after dust is separated from the air.

A dust collector mount 940 may be formed above the main body inlet 920 that receives the dust collector 1000, and an air outlet 950 may be formed at a predetermined side of the dust collector mount 940 that allows air introduced into the main body 910 through the main body inlet 920 to flow into the dust collector 1000.

The dust collector 1000 may include a dust separation device 1010 that separates dust from sucked in air, a dust collector body 1050 detachably coupled to the dust separation device 1010 that stores the dust separated by the dust separation device 1010, and an upper cover 1030 coupled to a top portion of the dust separation device 1010.

The dust separation device 1010 may include a cylindrical cyclone part 1011 that separates dust from sucked in air using a cyclone. That is, the cyclone part 1011 may separate air and dust by swirling the air and the dust to apply different centrifugal forces to the air and the dust.

An inlet 1012 may be formed in an upper portion of the cyclone part 1011 to introduce air and dust into the cyclone part 1011. The inlet 1012 may be formed in a tangential direction of the cyclone part 1011 to generate a cyclone in the cyclone part 1011.

A discharge hole 1032 may be formed in a center portion of the upper cover 1030, that discharges air from the dust separation device 1010 (for example, from the cyclone part 1011) after dust is separated from the air. A filter member 1040 may be attached to a rear side of the upper cover 1030. The filter member 1040 may include a plurality of penetration holes 1042 in an outer surface that discharges air from the cyclone part 1011. Air may be discharged from the cyclone part 1011 through the filter member 1040 and the discharge hole 1032 after dust is separated from the air in the cyclone part 1011. A dust outlet 1018 may be formed in a lower side of the dust separation device 1010 that discharges separated dust.

The dust collector body 1050 may be coupled to a lower side of the dust separation device 1010. A dust storage chamber 1055 may be formed in the dust collector body 1050 that stores dust separated by the dust separation device 1010.

An upper grip 1013 and a lower grip 1051 may be formed on the dust separation device 1010 and the dust collector body 1050, respectively. Thus, the dust separation device 1010 and the dust collector body 1050 may be easily handled and carried using the grips 1013 and 1051.

The dust collector 1000 may have a hook structure that couples the dust separation device 1010 and the dust collector body 1050. For example, a hook ring 1014 may be formed on a lower outer surface of the dust separation device 1010, and a hook latch 1053 corresponding to the hook ring 1014 may be formed on an upper outer surface of the dust collector body 1050.

First and second pressing members 1060 and 1070 may be disposed in the dust collector 1000 that reduce a volume of the dust stored in the dust storage chamber 1055 to increase a dust collecting capacity of the dust collector 1000. The first pressing member 1060 may be coupled to a lower side of the dust separation device 1010, and the second pressing member 1070 may be formed inside the dust collector body 1050. The first pressing member 1060 may be rotated by a driving device or driver, which is described later in detail, to press dust against both sides of the second pressing member 1070.

The driving device may be disposed in the dust separation device 1010 and may be connected to the first pressing member 1060. The driving device may include a compression motor 1100 that generates a driving force and a driving gear 1110 that transmits the driving force of the compression motor 1100 to the first pressing member 1060.

The compression motor 1100 may be disposed in a motor accommodation part 1016 formed at a lower portion of the dust separation device 1010. After the compression motor 1100 is disposed in the motor accommodation part 1016, a cover member 1020 may close a lower portion of the dust separation device 1010.

The cover member 1020 may be detachably coupled to the lower portion of the dust separation device 1010, so that the compression motor 1100 may be easily repaired or replaced with a new one. The cover member 1020 may include an opening 1022 to allow dust to fall from the dust outlet 1018 to the dust collector body 1050.

The driving gear 1110 may be connected between a motor shaft 1102 of the compression motor 1100 and a rotational shaft 1062 of the first pressing member 1060. The driving gear 1110 may function as a power transmission member.

A gear joint portion 1063 may be formed at an end of the rotational shaft 1062. The gear joint portion 1063 may have a shape corresponding to the driving gear 1110. After the driving gear 1110 is coupled to the rotational shaft 1062, a fastening member 1064 may be inserted from a bottom of the rotational shaft 1062 to fasten the rotational shaft 1062 and the driving gear 1110 together.

A terminal part 1124 may be formed at a side portion of the dust separation device 1010. The terminal part 1124 may be connected to the compression motor 1100 through a connector 1122. When the dust collector 1000 is mounted on the dust collector mount 940, the terminal part 1124 may be connected to a power supply terminal 942 formed in the dust collector mount 940. The dust collector 1000 may compress dust in the same manner as described with respect to the previous embodiments. Thus, a detailed description thereof has been omitted.

As explained above, the dust separation device 1010 and the dust collector body 1050 may detachably coupled to each other, and the compression motor 1100 may be disposed in the dust separation device 1010. In this case, a weight of the dust collector body 1050 may be reduced, so that dust stored in the dust collector body 1050 may be easily removed.

Figure 13:
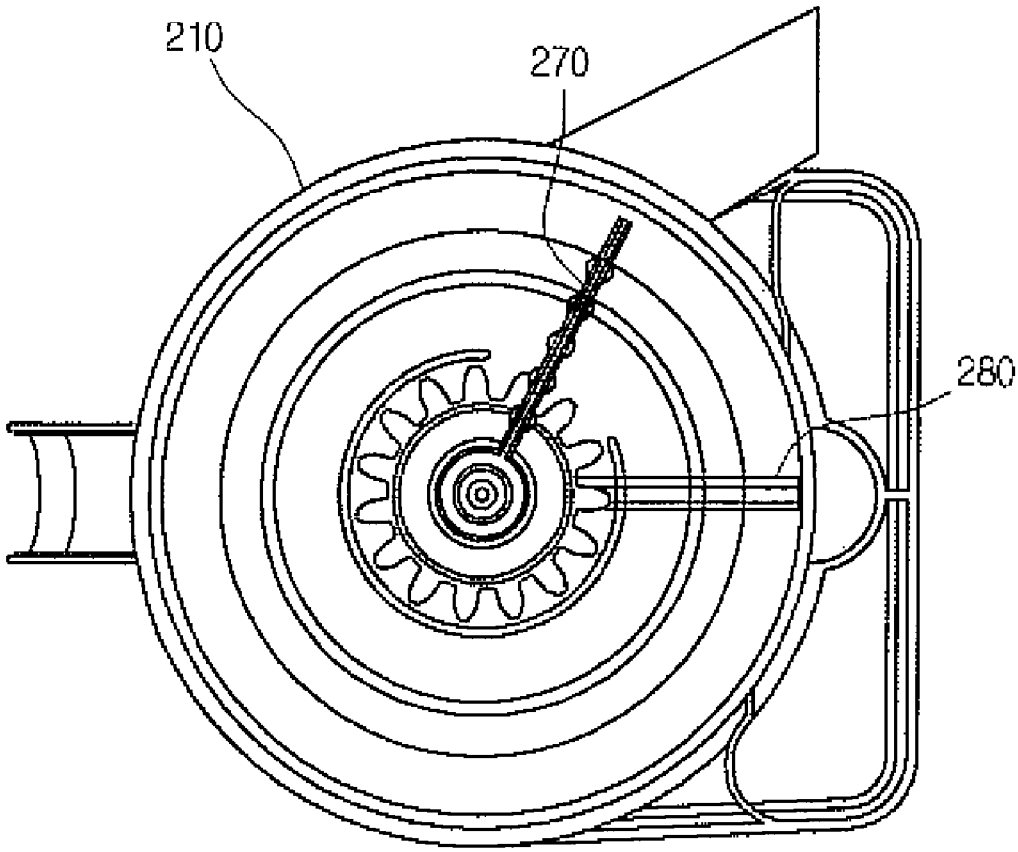
FIG. 13 is a front, exploded perspective view of a vacuum cleaner when a dust collector is detached from the vacuum cleaner according to another embodiment.

FIG. 13 is a front, exploded perspective view of a vacuum cleaner 1200 when a dust collector 1300 is detached from the vacuum cleaner 1200 according to another embodiment. Referring to FIG. 13, the vacuum cleaner 1200 of this embodiment may include a main body 1210 and the dust collector 1300. A suction motor (not shown) may be disposed in the main body 1210 that generates a suction force. The dust collector 1300 may separate dust from air sucked into the main body 1210 and store the separated dust.

The vacuum cleaner 1200 may further include a suction nozzle 1214 that sucks in air and dust, a handle 1211 for the suction nozzle 1214, an extension pipe 1212 that connects the suction nozzle 1214 and the handle 1211, and a connection hose 1213 that connects the handle 1211 and the main body 1210. In this embodiment, detailed descriptions of basic structures of the suction nozzle 1214, the extension pipe 1212, the handle 1211, and the connection hose 1213 have been omitted.

A main body inlet 1217 may be formed in a front lower portion of the main body 1210 that introduces air and dust sucked in through the suction nozzle 1214 into the main body 1210. Air and dust introduced through the main body inlet 1217 may be directed to the dust collector 1300 to separate the dust from the air.

A dust collector mount 1216 may be formed on the main body 1210 that receives the dust collector 1300. An air outlet 1218 may be formed in a bottom surface of the dust collector mount 1216, to allow air and dust introduced into the main body 1210 through the main body inlet 1217 to flow to the dust collector 1300.

The dust collector 1300 may include a dust collector body 1310, in which a dust storage chamber may be formed, and a cover member 1330 that selectively opens and closes a top of the dust collector body 1310. A driving device or driver 1400 may be disposed on the cover member 1330 that drives a pressing member, which is described later in detail, to compress dust stored in the dust storage chamber of the dust collector body 1310. A guide 1219 may be formed on the main body 1210 that guides the driving device 1400 when the dust collector 1300 is mounted on the main body 1210.

An exemplary structure of the dust collector 1300 will now be described in detail.

Figure 14:
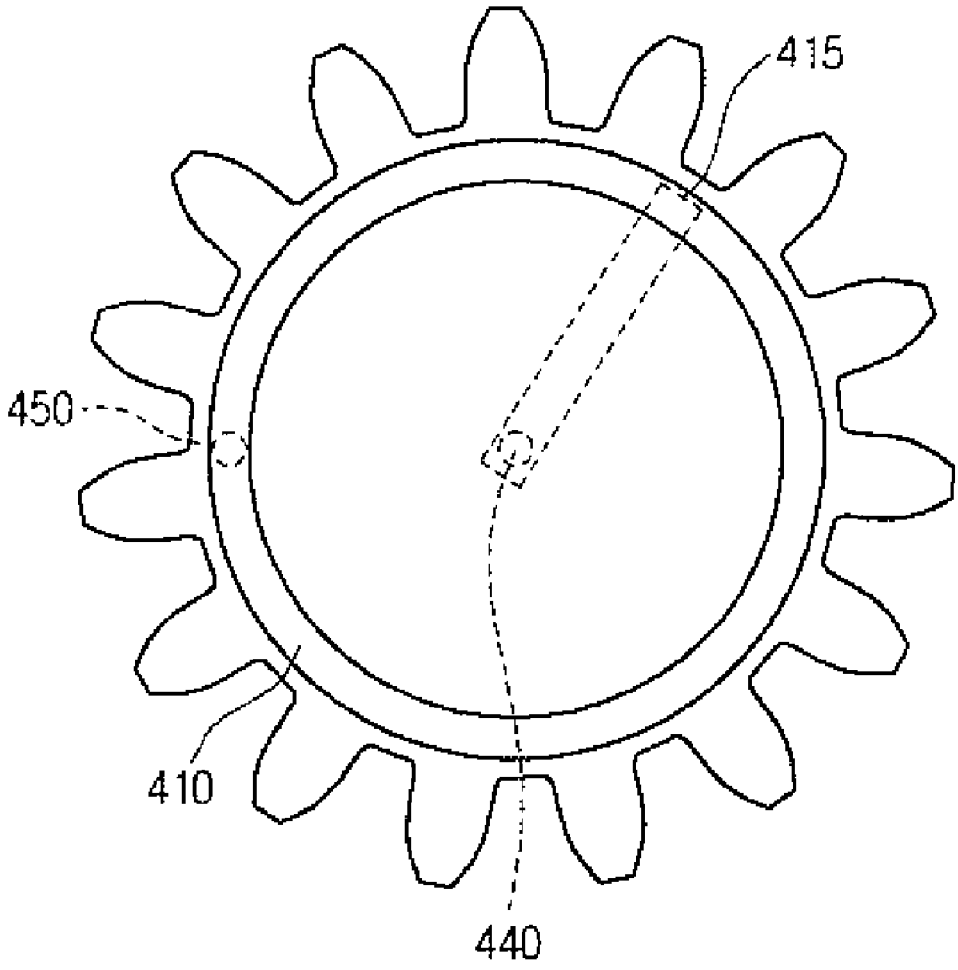
FIG. 14 is a front, perspective view of the dust collector when a cover member is detached from the dust collector of the vacuum cleaner of FIG. 13.
Figure 15:
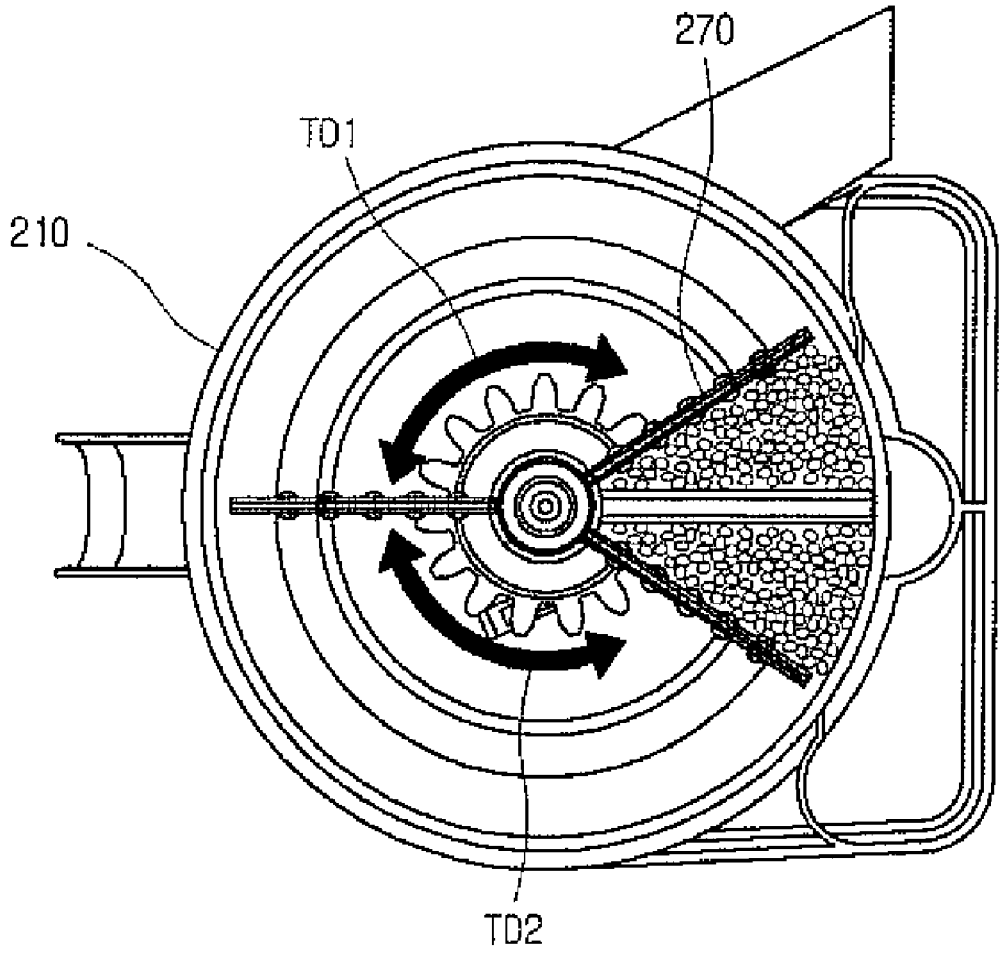
FIG. 15 is a vertical sectional view of the dust collector of the vacuum cleaner of FIG. 13.
Figure 16:
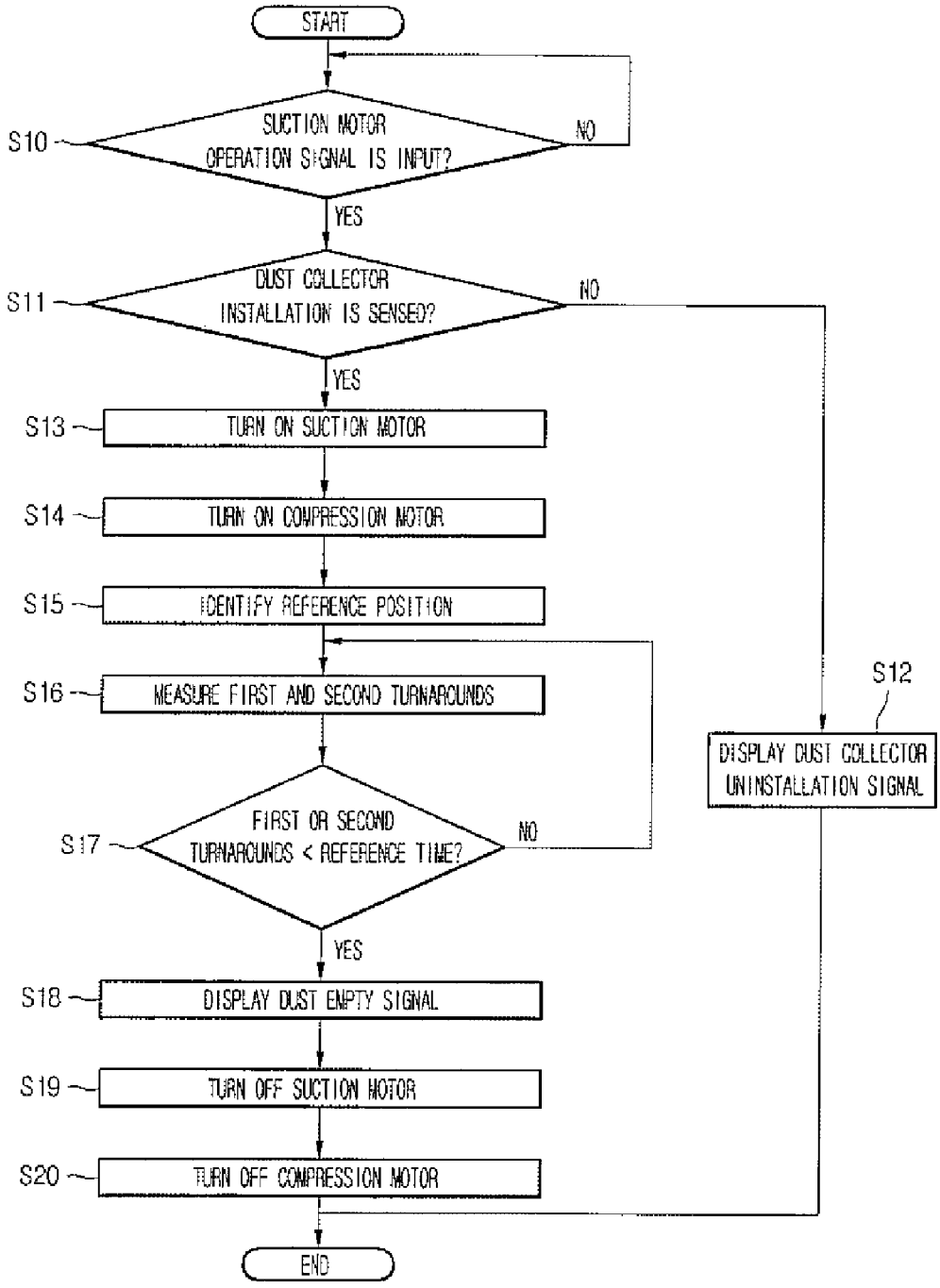
FIG. 16 is a bottom view of the dust collector of the vacuum cleaner of FIG. 13.

FIG. 14 is a front, perspective view of the dust collector 1300 when the cover member 1330 is detached from the dust collector 1300 of the vacuum cleaner of FIG. 13. FIG. 15 is a vertical sectional view of the dust collector 1300 of the vacuum cleaner of FIG. 13. FIG. 16 is a bottom view of the dust collector 1300 of the vacuum cleaner of FIG. 13.

Referring to FIGS. 14 to 16, the dust collector 1300 of this embodiment may include the dust collector body 1310 that forms an exterior of the dust collector 1300, a cyclone part 1321 disposed in the dust collector body 1310 that separates dust from sucked in air, and the cover member 1330 that selectively opens and closes a top of the dust collector body 1310.

The dust collector body 1310 may have a cylindrical shape. The cyclone part 1321 may be formed at a center portion of the dust collector body 1310, and a dust storage chamber 1322 may be formed in the dust collector body 1310 around the cyclone part 1321. The dust collector body 1310 may include an outer wall 1311, an inner wall 1313, and a bottom wall 1312 to form the dust storage chamber 1322.

The cyclone part 1321 may be a part in which dust is separated from air by a centrifugal force. The cyclone part 1321 may be formed by the inner wall 1313 and the bottom wall 1312.

The inner wall 1313 may be lower than the outer wall 1311. In this case, a connection passage (P) may be formed to allow movement of separated dust from the cyclone part 1321 to the dust storage chamber 1322.

An inlet 1314 may be formed in the bottom wall 1312 of the cyclone part 1321 to introduce air and dust into the cyclone part 1321. An air outlet 1316 may be formed in a center portion of the bottom wall 1312 of the cyclone part 1321, to discharge air from the cyclone part 1321 after dust is separated from the air, and a discharge pipe 1315 having a predetermined height may be attached, for example, by welding or bonding, to the air outlet 1316.

An air inlet 1220 (see FIG. 13) corresponding to the air outlet 1316 may be formed in the dust collector mount 1216 that introduces air discharged from the dust collector 1300 into the main body 1210. The discharge pipe 1315 may be substantially vertically disposed in the cyclone part 1321, such that air may be discharged from the dust collector body 1310 in a direction substantially parallel to a centerline of the dust collector body 1310 after dust is separated from the air. The discharge pipe 1315 may be lower than the inner wall 1313, so that air may be smoothly discharged through the discharge pipe 1315 after dust is separated from the air.

The discharge pipe 1315 may be formed integrally with the bottom wall 1312, for example, by molding. The discharge pipe 1315 may have various shapes, such as a rectangular shape, a triangular shape, or a circular shape. Due to this structure, air may be discharged from the dust collector 1300 through the discharge pipe 1315 and the air outlet 1316, in a direction of arrow F2, after dust is separated from the air.

A spiral flow guide 1323 may be disposed on the bottom wall 1312 around the discharge pipe 1315. Due to the flow guide 1323, air and dust introduced into the dust collector body 1310 through the inlet 1314 of the bottom wall 1312 may swirl upward toward the cover member 1330. The flow guide 1323 may extend from the bottom wall 1312 of the dust collector body 1310. Alternatively, the flow guide 1323 may be prepared as a separate part and then, may be attached, for example, by welding or bonding, to the bottom wall 1312.

Since the dust storage chamber 1322 may be formed around the cyclone part 1321, separation and storing of dust may be carried out at different places. Therefore, for example, even when the vacuum cleaner 1200 is turned over and dust is discharged downward around the cover member 1330 during cleaning, reverse movement of dust from the dust storage chamber 1322 to the cyclone part 1321 may be prevented. Further, since separation and storing of dust may be carried out at different places, a possibility of scattering or reverse movement of dust stored in the dust storage chamber 1322 may be reduced.

Both the cyclone part 1321 and the dust storage chamber 1322 may be opened and closed using the cover member 1330. Therefore, when the cover member 1330 is detached from the dust collector body 1310 to discharge dust stored in the dust storage chamber 1322, the top of the dust collector body 1310 may be completely opened. Then, dust may be easily removed from the dust storage chamber 1322 by holding or placing the dust collector body 1310 upside down.

Since both the inlet 1314 and the air outlet 1316 may be formed in the bottom wall 1312, the structure of the dust collector body 1310 may be simple and neat. Further, since the discharge pipe 1315 may be formed at the air outlet 1316 of the bottom wall 1312, dust remaining in the cyclone part 1321 may not be readily discharged from the cyclone part 1321 through the air outlet 1316, even when the vacuum cleaner 1200 is unexpectedly turned over.

A plurality of pressing members may be provided in the dust collector 1300 to compress dust stored in the dust storage chamber 1322 to increase a dust collecting capacity of the dust collector 1300. The pressing members may include a first pressing member 1440 and a second pressing member 1450. The first pressing member 1440 may be rotatably disposed in the dust storage chamber 1322, and the second pressing member 1450 may be fixedly disposed in the dust storage chamber 1322. A driving device or driver 1400 may rotate the first pressing member 1440.

The driving device 1400 may be coupled to a top of the cover member 1330, and a rotatable member 1430 may be disposed at a bottom of the cover member 1330. The first pressing member 1440 may be formed on the rotatable member 1430. The rotatable member 1430 may be connected to the driving device 1400 through a coupling part 1432. In more detail, the driving device 1400 may include a compression motor 1420 and a motor housing 1410, in which the compression motor 1420 is disposed.

After the compression motor 1420 is disposed in the motor housing 1410, the motor housing 1410 may be coupled to coupling ribs 1332 formed on a top of the cover member 1330. Coupling tabs 1412 may be formed on an outer surface of the motor housing 1410, and tab insertion holes 1333 may be formed in the coupling ribs 1332 that selectively receive the coupling tabs 1412.

When the driving device 1400 is coupled to the top of the cover member 1330, a motor shaft 1422 of the compression motor 1420 may be inserted into the cover member 1330, and the coupling part 1432 of the rotatable member 1430 may be coupled to the motor shaft 1422 through the cover member 1330. Therefore, when the compression motor 1420 rotates, the rotatable member 1430 connected to the compression motor 1420 may be rotated. Thus, the first pressing member 1440 may also be rotated.

A terminal part 1414 may be formed at a side of the compression motor 410 and may be connected to the compression motor 1420. When the dust collector 1300 is mounted on the dust collector mount 1216, the terminal part 1414 may be connected to a power supply terminal 1221 (see FIG. 17) formed in the dust collector mount 1216.

The first pressing member 1440 may extend downward from the rotatable member 1430 a predetermined length. The first pressing member 1440 may be spaced apart from a rotational centerline of the rotatable member 1430.

A plurality of first pressing members 1440 may be provided. The first pressing member 1440 may have a width smaller than a distance between the inner wall 1313 and the outer wall 1311 of the dust collector body 1310, so as to be disposed in the dust storage chamber 1322 of the dust collector body 1310 when the cover member 1330 is coupled to the dust collector body 1310.

The second pressing member 1450 may extend upward from the bottom wall 1312 to a predetermined height and may be located between the inner wall 1313 and the outer wall 1311. The second pressing member 1450 may be formed integrally with the inner wall 1313 or the outer wall 1311. A plurality of second pressing members 1450 may be provided. In this case, a number of the second pressing members 1450 may correspond to a number of the first pressing members 1440.

The first pressing member 1440 may extend downward close to the bottom wall 1312, and the second pressing member 1450 may extend upward close to the cover member 1330. In this case, dust may be effectively compressed by interaction between the first and second pressing members 1440 and 1450. That is, the first and second pressing members 1440 and 1450 may be shaped to increase an overlapping area between the first and second pressing members 1440 and 1450.

When the cover member 1330 is coupled to the top of the dust collector body 1310, a connection passage (P) may be formed between the cover member 1330 and the dust collector body 1310 to connect the cyclone part 1321 and the dust storage chamber 1322. A backflow restriction part 1434 may be formed on a bottom surface of the rotatable member 1430 that screens a portion of the connection passage (P). The backflow restriction part 1434 may have a circular shape and may be located inside the first pressing member 1440.

When the cover member 1330 is coupled to the dust collector body 1310, a height of the backflow restriction part 1434 may be smaller than a width of the connection passage (P), such that the backflow restriction part 1434 may screen the connection passage (P) partially to form a ring-shaped auxiliary passage (P1). Dust separated at the cyclone part 1321 may be discharged downward to the dust storage chamber 1322 through the auxiliary passage (P1).

The backflow restriction part 1434 may have an outer diameter greater than that of the cyclone part 1321. Therefore, dust separated from air and moving in the direction of arrow (A) may be guided by the backflow restriction part 1434 down to the dust storage chamber 1322, and to the cyclone part 1321, through the auxiliary passage (P1), as indicated by arrow (C). Due to the downstream flow of dust through the auxiliary passage (P1), a backflow of dust from the dust storage chamber 1322 to the cyclone part 1321 may be prevented.

Figure 17:
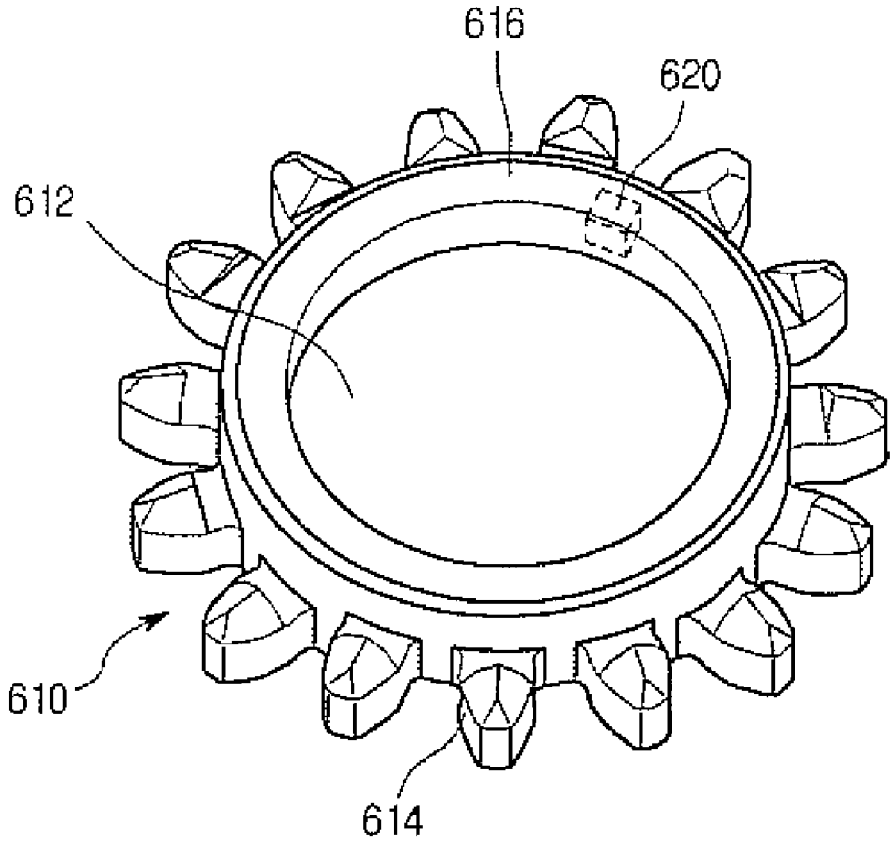
FIG. 17 is a partial sectional view of an upper structure of a dust collector mount of a main body of the vacuum cleaner of FIG. 13.

FIG. 17 is a partial sectional view of an upper structure of the dust collector mount 1216 of the main body 1210 of the vacuum cleaner of FIG. 13. Referring to FIG. 17, as explained above, the dust collector mount 1216 may be formed in the main body 1210 and may be configured to the dust collector 1300. A guide 1219 may be formed in the dust collector mount 1216 in a front-to-back direction to guide the dust collector 1300 when the dust collector 1300 is mounted on the dust collector mount 1216 of the main body 1210.

A power supply terminal 1221 may be formed at a rear portion of the dust collector mount 1216. The power supply terminal 1221 may be selectively connected to the terminal part 1414 of the driving device 1400. The power supply terminal 1221 may be connected to a power supply (not shown) through a connection line 1222.

Figure 18:
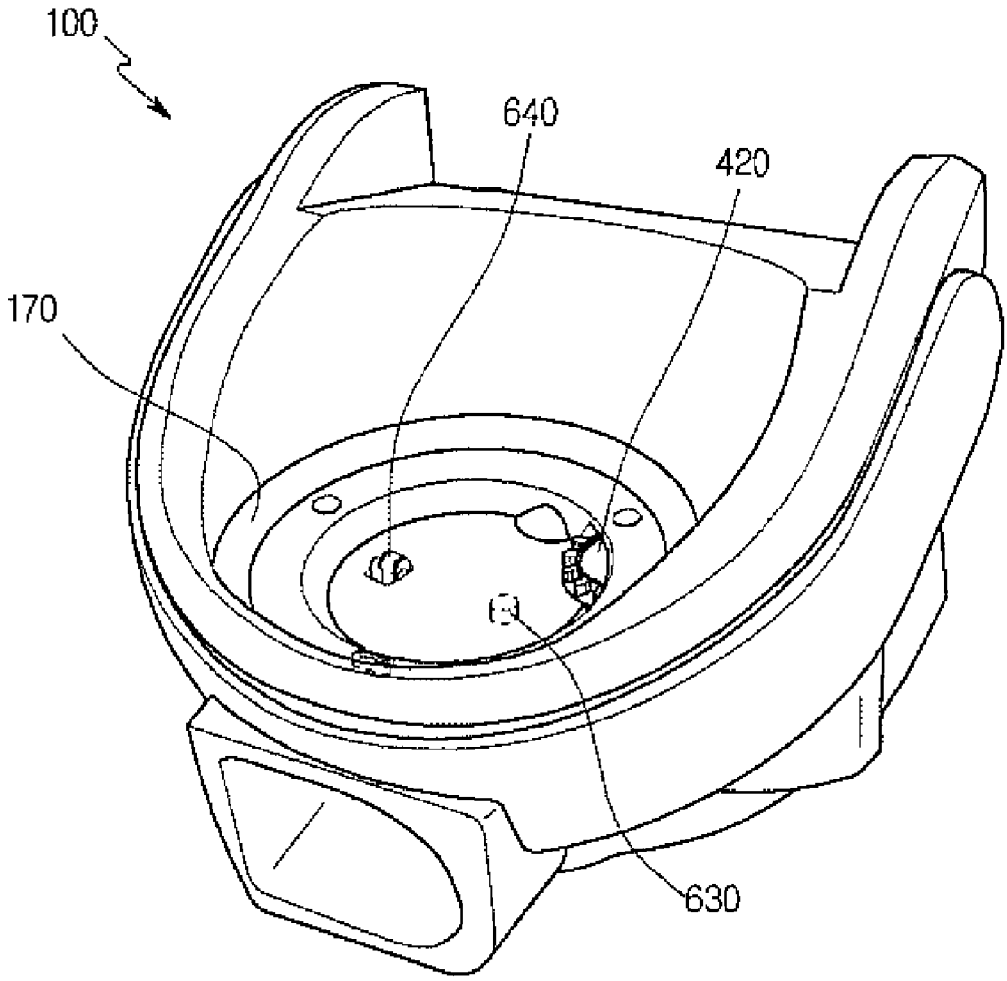
FIG. 18 is a view that illustrates how dust is compressed by pressing members in a dust storage chamber of the dust collector of the vacuum cleaner of FIG. 13.

FIG. 18 is a view that illustrates how dust is compressed by the pressing members 1440 and 1450 in the dust storage chamber 1322. An exemplary operation of the vacuum cleaner 1200 will now be described in association with dust compression procedures with reference to FIGS. 15 and 18.

Before starting cleaning, the dust collector 1300 may be mounted on the dust collector mount 1216. Then, the terminal part 1414 of the driving device 1400 may be connected to the power supply terminal 1221 of the dust collector mount 1216.

Next, the suction motor (not shown) may be powered on to suck air and dust into the cyclone part 1321 through the inlet 1314. In the cyclone part 1321, the air and the dust may swirl upward to the cover member 1330 via the flow guide 1323.

While the air and the dust swirl upward, the dust may be separated from the air by a centrifugal force and be discharged from the cyclone part 1321 through the connection passage (P). The dust discharged through the connection passage (P) in the direction of arrow (A) may collide with the backflow restriction part 1434. Then, the dust may move downward to the dust storage chamber 1322 through the auxiliary passage (P1), as indicated by arrow (C). Also, the dust discharged through the connection passage (P) may move down to the dust storage chamber 1322 through the auxiliary passage (P1) without colliding with the backflow restriction part 1434, as indicated by arrow (B).

At the same time or sequentially, a stream of air carrying the separated dust may collide with the backflow restriction part 1434, as indicated by arrow (A), and move down to the dust storage chamber 1322 through the auxiliary passage (P1), as indicated by arrow (C). Due to the air stream moving down to the dust storage chamber 1322, dust stored in the dust storage chamber 1322 may be prevented from rising to the cover member 1330.

After the dust is separated from the air, the air may be discharged from the dust collector 1300 through discharge pipe 1315 and air outlet 1316, as indicated by arrow (F2). Then, the air discharged from the dust collector 1300 may pass through a discharge filter and be directed back to the main body 1210.

While dust is separated from air using a suction force generated by the suction motor, the driving device 1400 may rotate the first pressing member 1440 to compress dust stored in the dust storage chamber 1322. The compression motor 1420 may rotate the rotatable member 1430. Then, the first pressing member 1440 may be rotated together with the rotatable member 1430 in a predetermined direction to compress dust.

While the first pressing member 1440 compresses the dust, a reaction force may be applied to the first pressing member 1440. If the reaction force reaches or exceeds a preset value, the rotation of the compression motor 1420 may be reversed. In this case, the first pressing member 1440 may rotate in a reverse direction to compress the dust on the other side. In this way, the first pressing member 1440 may compress dust stored in the dust storage chamber 1322 while rotating in both directions. The compression motor 1420 may stop when the suction motor stops.

Figure 19:
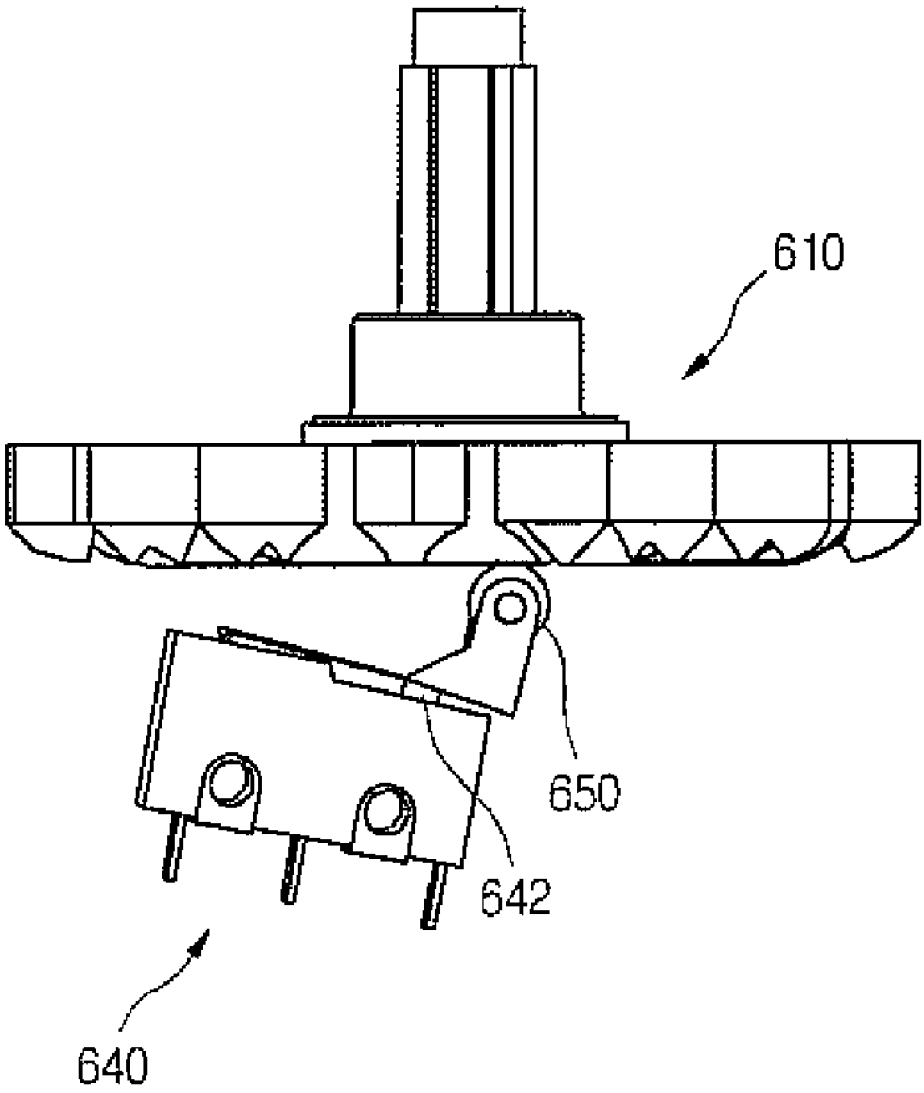
FIG. 19 is a partial sectional view of a coupling structure between a dust collector and a driving device according to another embodiment.

FIG. 19 is a partial sectional view of a coupling structure between a dust collector 1600 and a driving device 1700 according to another embodiment. Referring to FIG. 19, the dust collector 1600 of this embodiment may include a dust collector body 1610 and a cover member 1620 selectively coupled to an upper side of the dust collector body 1610. The dust collector body 1610 of this embodiment may have the same structure as the dust collector body 1310 of the previous embodiment, and thus, repetitive disclosure has been omitted.

The driving device 1700 of this embodiment may include a compression motor 1710 and power transmission members. The power transmission members may transmit a driving force of the compression motor 1710 to a first pressing member 1640.

The power transmission members may include a driving gear 1720 and a driven gear 1730. The driven gear 1730 may be coupled to the first pressing member 1640, and the driving gear 1720 may transmit power to the driven gear 1730. The driving gear 1720 may be coupled to a motor shaft 1712 of the compression motor 1710, such that the driving gear 1720 may be rotated by the compression motor 1710.

A rotatable member 1630 may be coupled to a bottom surface of the cover member 1620, and the first pressing member 1640 may be formed on the rotatable member 1630. The rotatable member 1630 may include a coupling part 1632 that extends upward through the cover member 1620. A spindle 1732 of the driven gear 1730 may be coupled to the coupling part 1632.

A support rib 1622 may be formed on a top of the cover member 1620, that supports the driven gear 1730 and spaces the driven gear 1730 apart from the top of the cover member 1620. A dust collector mount 1510 may be formed in a cleaner main body 1500, and the dust collector 1600 may be mounted on the dust collector mount 1510.

The compression motor 1710 may be disposed in the dust collector mount 1510, and the driving gear 1720 coupled to the compression motor 1710 may be partially exposed to the dust collector mount 1510 from the cleaner main body 1500. For this, an opening 1520 may be formed in the cleaner main body 1500 that partially exposes a periphery of the driving gear 1720 toward the dust collector mount 1510.

As explained above, the driven gear 1730 may be disposed at the top of the dust collector 1600, and the driving gear 1720 may be partially exposed from the cleaner main body 1500 to the dust collector mount 1510. Therefore, when the dust collector 1600 is mounted on the dust collector mount 1510, the driven gear 1730 may be engaged with the driving gear 1720.

Figure 20:
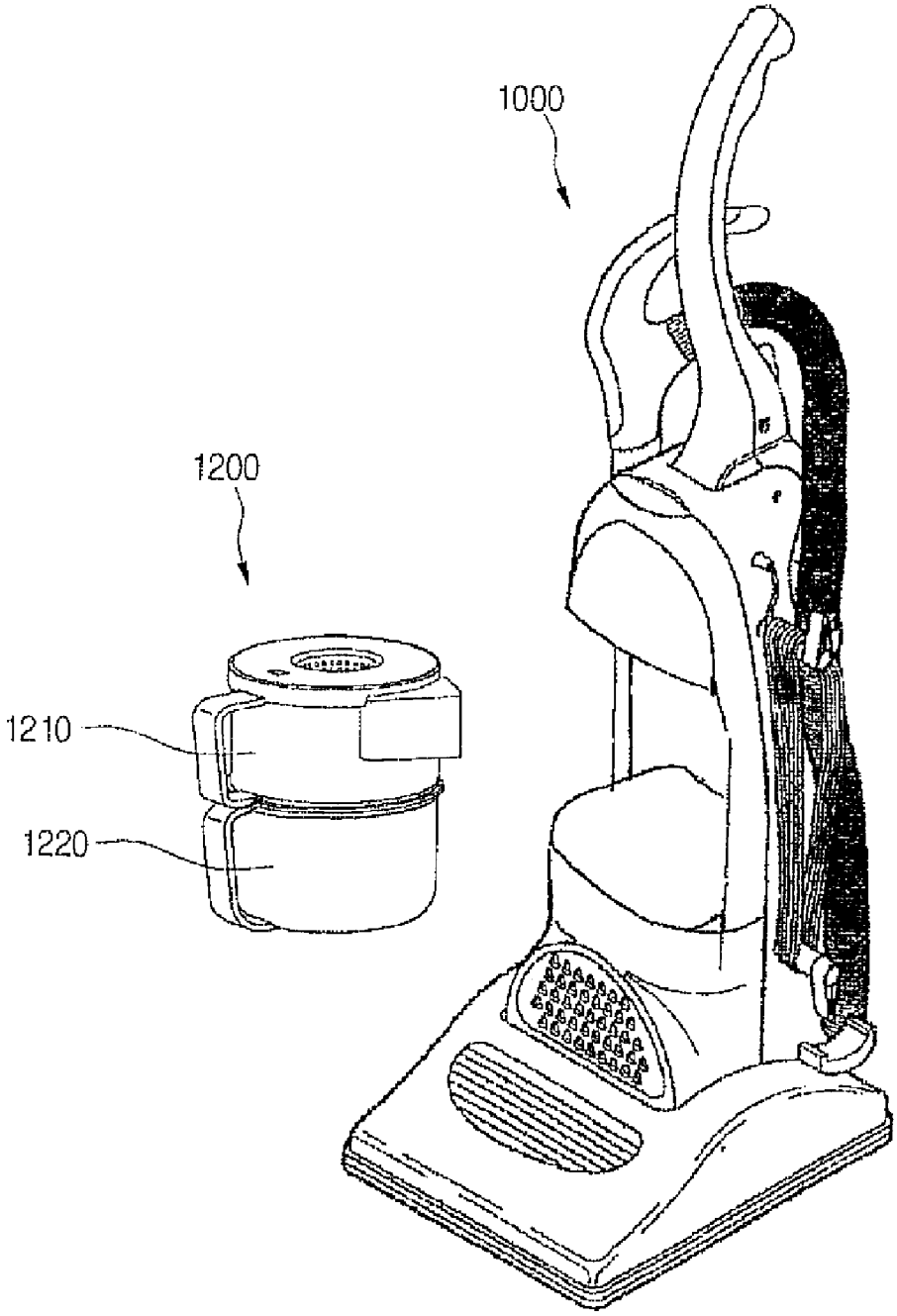
FIG. 20 is a front perspective view of an upright vacuum according to an embodiment.

Any of the embodiments disclosed herein may be employed in an upright vacuum cleaner, such as the vacuum cleaner 1000 shown in FIG. 20. Further, the dust separator 1210 may be contained within the dust collector body 1220 or the dust separator 1210 may be separately provided from the dust collector body 1220. More detailed explanations of upright vacuum cleaners are provided in U.S. Pat. Nos. 6,922,868 and 7,462,210, which are hereby incorporated by reference.

According to embodiments disclosed herein, dust stored in the dust collector may be compressed by the pressing member so that a dust collecting capacity of the dust collector may be increased. Thus, industrial applicability of the vacuum cleaner is high.

Embodiments disclosed herein provide a vacuum cleaner that may include a dust collector having an increased dust collecting capacity by compressing dust. Embodiments also provide a vacuum cleaner in which dust may be removed from a dust collector without scattering the dust.

In one embodiment disclosed herein, there is provided a vacuum cleaner that may include a main body; a dust collector detachably attached to the main body and including a dust storage chamber; a pressing member that compresses dust stored in the dust storage chamber; and a driving device or driver disposed in the dust collector that actuates the pressing member.

In another embodiment disclosed herein, there is provided a vacuum cleaner that may include a dust separation device; a dust collector body, in which a dust storage chamber is disposed that stores dust separated by the dust separation device; a pressing member that compresses dust stored in the dust storage chamber; a driving device or driver coupled to the dust collector body that actuates the pressing member; and a main body, to which the dust collector body is detachably attached.

In another embodiment disclosed herein, there is provided a vacuum cleaner that may include a dust separation device; a dust collector body, in which a dust storage chamber is disposed that stores dust separated by the dust separation device; a pressing member that compresses dust stored in the dust storage chamber; and a driving device or driver disposed in the dust separation device that actuates the pressing member.

In another embodiment disclosed herein, there is provided a vacuum cleaner that may include a dust separation device; a dust collector, in which a dust storage chamber is disposed that stores dust separated by the dust separation device; a pressing member that compresses dust stored in the dust storage chamber; and a driving device or driver disposed at an upper side of the dust storage chamber that actuates the pressing member.

In another embodiment disclosed herein, there is provided a vacuum cleaner that may include a dust collector that includes a dust separation device and a dust storage chamber; a pressing member in the dust storage chamber that compresses dust stored in the dust storage chamber; a driving device or driver disposed in the dust collector that actuates the pressing member; and a terminal part connected to the driving device, the terminal part transmitting power to the driving device when connected to a power supply.

According to the embodiments disclosed herein, the pressing member may compress dust stored in the dust collector so that a dust collecting capacity of the dust collector may be increased. Further, since the dust collecting capacity of the dust collect may be increased by compressing dust using the pressing member, removal of dust from the dust collector may be performed less frequently. Furthermore, since dust is stored in the dust collector in a compressed state, the dust may not readily be scattered when the dust may removed be from the dust collector.

Also, the driving device that actuates the pressing member may be detachably attached to the dust collector. Therefore, when cleaning the dust collector, the driving device may be detached from the dust collector to protect the driving device from permeation of water. In addition, when the driving device is detached from the dust collector, the driving device may be easily repaired and replaced with a new one.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a main body in which a suction motor that generates a suction force is disposed;

a dust collector detachably attached to the main body and including a dust storage chamber; and at least one pressing member that compresses dust stored in the dust storage chamber, wherein the dust collector includes a driver that actuates the at least one pressing member, wherein the driver comprises a compression motor connected to the at least one pressing member and bidirectionally rotatable, and wherein the dust collector is detached from the main body together with the compression motor in a state in which the suction motor is disposed in the main body.

2. The vacuum cleaner according to claim 1, wherein the driver is detachably coupled to the dust collector.

3. The vacuum cleaner according to claim 1, wherein the driver is disposed on the dust collector.

4. The vacuum cleaner according to claim 1, further comprising:

a power supply terminal provided on the main body that supplies power to the compression motor; and a terminal part connected to the compression motor, wherein when the dust collector is attached to the main body, the terminal part is connected to the power supply terminal.

5. The vacuum cleaner according to claim 1, wherein the at least one pressing member comprises a first pressing member disposed in the dust storage chamber and which is bidirectionally rotatable.

6. The vacuum cleaner according to claim 5, wherein the at least one pressing member further comprises a fixed member disposed in the dust storage chamber, the fixed member interacting with the first pressing member to compress dust.

7. A vacuum cleaner, comprising:

a dust separation device;

a dust collector body, in which a dust storage chamber is disposed that stores dust separated by the dust separation device;

at least one pressing member that compresses dust stored in the dust storage chamber;

a driver coupled to the dust collector body that actuates the at least one pressing member; and a main body, to which the dust collector body is detachably attached, the main body including a suction motor configured to generate a suction force, wherein the driver comprises a compression motor connected to the at least one pressing member and bidirectionally rotatable, wherein the main body comprises a power supply terminal that supplies power to the driver, and wherein the driver further comprises a terminal part connected to the compression motor, the terminal part being selectively connected to the power supply terminal.

8. The vacuum cleaner according to claim 7, wherein the driver is connected to a rotational shaft of the at least one pressing member, and the driver or the rotational shaft is inserted through the dust collector body.

9. The vacuum cleaner according to claim 7, wherein the dust storage chamber comprises a compartment rib under a rotational shaft of the at least one pressing member.

10. The vacuum cleaner according to claim 7, wherein the at least one pressing member comprises a first pressing member that rotates and a fixed member that interacts with the first pressing member to compress dust, wherein the first pressing member is bidirectionally rotatable.

11. A vacuum cleaner, comprising:

a main body in which a suction motor that generates a suction force is disposed;

a dust separation device configured to communicate with the main body;

a dust collector body, in which a dust storage chamber is disposed that stores dust separated by the dust separation device;

at least one pressing member that compresses dust stored in the dust storage chamber;

a driver disposed in the dust separation device that actuates the at least one pressing member;

a terminal part that transmits power to the driver when connected to the power supply terminal; and a power supply terminal on the main body that supplies power to the driver, wherein the driver comprises a compression motor connected to the at least one pressing member and bidirectionally rotatable.

12. The vacuum cleaner according to claim 11, wherein the at least one pressing member is connected to the driver from under the dust separation device.

13. The vacuum cleaner according to claim 11, wherein the dust separation device comprises:

an accommodation part that accommodates the driver; and a cover member that covers the accommodation part.

14. A vacuum cleaner, comprising:

a dust separation device;

a dust collector, in which a dust storage chamber is disposed that stores dust separated by the dust separation device, the dust separation device being disposed in the dust collector;

at least one pressing member that compresses dust stored in the dust storage chamber;

a cover member configured to open and close both the dust separation device and the dust storage chamber; and a driver disposed at an upper side of the dust storage chamber that actuates the at least one pressing member, wherein the driver is disposed on the cover member.

15. The vacuum cleaner according to claim 14, further comprising a rotatable member disposed at a lower side of the cover member and rotatable by the driver, wherein the at least one pressing member extends downward from the rotatable member.

16. The vacuum cleaner according to claim 15, wherein the rotatable member comprises a coupling part configured to join the rotatable member to the cover member, and the coupling part or the driver is inserted through the cover member.

17. A vacuum cleaner, comprising:

a main body in which a suction motor that generates suction force is disposed;

a dust collector mounted on the main body and including a dust separation device and a dust storage chamber;

at least one pressing member in the dust storage chamber that compresses dust stored in the dust storage chamber;

a driver disposed in the dust collector that actuates the at least one pressing member; and a terminal part connected to the driver, the terminal part transmitting power to the driver when connected to a power supply, wherein the driver comprises a compression motor connected to the at least one pressing member and bidirectionally rotatable.

* * * * *